US005419656A

United States Patent [19]

McKinnon

[11] Patent Number: 5,419,656

[45] Date of Patent: May 30, 1995

[54] POOL APPARATUS AND METHOD OF MAKING

[76] Inventor: Gordon McKinnon, 119 S. Oregon Ave., Tampa, Fla. 33606

[21] Appl. No.: 27,402

[22] Filed: Mar. 8, 1993

Related U.S. Application Data

[63] Continuation-in-part of Ser. No. 790,649, Nov. 8, 1991, Pat. No. 5,192,162.

[51] Int. Cl.[6] ..... E04H 3/18

[52] U.S. Cl. ..... 405/55; 4/506; 52/169.7; 52/742

[58] Field of Search ..... 405/53, 55; 4/488, 506, 4/513; 52/2.15, 169.7, 259, 582.1, 742; 264/31

[56] References Cited

U.S. PATENT DOCUMENTS

| | | | |
|---|---|---|---|
| 3,487,599 | 1/1970 | Jansen | 52/169.7 |
| 3,511,002 | 5/1970 | Fox | 52/169.8 X |
| 3,585,655 | 6/1971 | Lankheet | 52/169.7 X |
| 3,638,378 | 2/1972 | Russ | 52/169.7 X |
| 4,015,383 | 4/1977 | Crowley | 52/259 X |
| 4,090,266 | 5/1978 | Price | 52/169.7 |
| 4,167,084 | 9/1979 | Brunton | 52/169.7 |
| 4,407,102 | 10/1983 | Boyack | 52/169.7 |
| 4,720,949 | 1/1988 | Taylor | 52/169.7 |
| 4,756,033 | 7/1988 | Schelfhorst | 4/506 |
| 4,843,658 | 7/1989 | Hodak | 4/506 |
| 5,025,601 | 6/1991 | Hand | 4/506 X |

FOREIGN PATENT DOCUMENTS

| | | | |
|---|---|---|---|
| 689044 | 6/1964 | Canada | 4/506 |

*Primary Examiner*—Randolph A. Reese
*Assistant Examiner*—John A. Ricci
*Attorney, Agent, or Firm*—Frijouf, Rust & Pyle

[57] ABSTRACT

An apparatus and method is disclosed for an improved swimming pool comprising a base forming the bottom of the pool. A sidewall extends about a peripheral edge of the base. The sidewall has an inner surface facing an interior of the pool, and an outer surface facing an exterior of the pool. An inner coating is disposed on the inner surface of the sidewall and on the base for affixing the sidewall to the base and for forming an interior surface for the pool. The sidewall comprises a plurality of flexible panels, which define a plurality of vertical joints. A plurality of upright supports are affixed to the outer surface of the sidewall at the vertical joints. A plurality of contour panels are affixed to the outer surface of the sidewall proximate the vertical joints and define a plurality of cavities therebetween. The cavities contain the upright supports. A plurality of vertical support columns are molded within the cavities for supporting the sidewall and integrally joining the flexible panels.

17 Claims, 13 Drawing Sheets

POOL APPARATUS AND METHOD OF MAKING

CROSS-REFERENCE TO RELATED APPLICATIONS

This is a continuation-in-part of U.S. Pat. application Ser. No. 07/790,649, filed Nov. 8, 1991, now U.S. Pat. No. 5,192,162. All subject matter set forth in application Ser. No. 07/790,649, filed Nov. 8, 1991, is hereby incorporated by reference into the present application as if fully set forth herein.

BACKGROUND OF THE INVENTION

1. Field Of The Invention

This invention relates to swimming pools and the like and more particularly to an improved apparatus and method of rapidly making a swimming pool from readily transportable component materials.

2. Background of the Invention

With the advent of more leisure time, the popularity of swimming pools has increased substantially in the last several decades. In general, swimming pools may be constructed as an in ground pool or as an above ground pools. In an in ground pool, soil is excavated from the pool site and a hardenable material such as a cementitious material is applied to form the bottom and sidewalls of the swimming pool. Examples of in- ground pools are illustrated in U.S. Pat. No. 2,887,759; U.S. Pat. No. 3,015,191 and U.S. Pat. 3,568,392. In a typical above ground pool, the pool site may be excavated and a retaining wall is erected around the perimeter of the excavated pool. A pool liner generally made of a flexible sheet plastic material is affixed to the peripheral wall to cover the excavated hole thus making the pool water tight. An example of an above ground pool is set forth in U.S. Pat. No. 3,177,501.

Above ground pools are generally less expensive than an in ground pool since the hardenable material forming the bottom and sidewalls of the in ground pool is replaced by a sheet plastic liner. Unfortunately, the vinyl liner of an above- ground pool does not provide the durability since the thin vinyl liner may be cut by a sharp object. Furthermore, the pool liners must be preformed of a particular size or must be fabricated at site thus limiting the shape and size of the swimming pool.

In an effort to reduce the cost of in ground pools, some in the prior art have utilized a plurality of ridged sidewall panels for forming the sidewalls of the in ground pool. U.S. Pat. No. 3,440,780; U.S. Pat. No. 3,468,088; U.S. Pat. No. 3,511,002 and U.S. Pat. No. 3,585,655 illustrate various ridged sidewall panels for constructing the sidewalls of an in ground swimming pool.

Others in the prior art have attempted to use a rolled sheet material for fabricating the sidewall of a swimming pool. U.S. Pat. No. 3,031,801; U.S. Pat. No. 3,930,346; U.S. Pat. No. 4,125,983; U.S. Pat. No. 4,263,759; U.S. Pat. No. 4,207,017 and U.S. Pat. No. 4,656,796 illustrate swimming pools having a sidewall formed from a rolled sheet material. The rolled sheet material was sometimes affixed to the bottom of a cementitious pool base by mechanical means such as shown in U.S. Pat. No. 3,975,782.

Thereafter, the sidewall and the bottom of the pool was covered by an external coating such as fiberglass or the like. U.S. Pat. No. 3,429,085; U.S. Pat. No. 3,823,690; U.S. Pat. No. 4,207,017; U.S. Pat. No. 4,409,772 and U.S. Pat. No. 4,948,296 all illustrate various external coatings for swimming pools.

Although the aforementioned prior art has contributed substantially to the reduction in cost of construction of swimming pools, the aforementioned prior art has certain disadvantages over a conventional cementitious in ground swimming pool. First, many of the in ground pools having a plurality of ridged sidewall panels had to be constructed in a specific size and shape thus limiting the size and shape of the completed swimming pool. Second, many of the swimming pools and construction techniques utilizing rolled material lacked the proper mechanical strength and sealing properties equivalent to a cementitious in ground swimming pool. Third, the external coating applied to the sidewalls of the swimming pools did not properly adhere to the sidewall material thus enhancing the possibility of the delamination of the external coating from the sidewall material. Such a delamination is totally unsatisfactory to a purchaser making a substantial investment of a swimming pool. Fourth, the use of a plurality of ridged sidewall panels or the use of the rolled sidewall materials were incapable of providing entrance steps for the pool. Accordingly the entrance steps for the pool were required to be manufactured in an conventional manner.

In my prior invention set forth in U.S. Pat. No. 5,192,162, the swimming pool utilized a sidewall made of polyethylene. Polyethylene, is inexpensive and offered flexibility desirable in the construction of swimming pools. However, polyethylene suffers from two major disadvantages. First, polyethylene did not allow the sprayed fiberglass coating to adhere well. To ensure good adhesion, holes were inserted in the sidewall, and both the interior and exterior surfaces were sprayed with fiberglass. As a result, the two surfaces would be affixed to one another at the holes, thus ensuring a secure fiberglass lamination on the polyethylene.

The second disadvantage which resulted from the use of a polyethylene sidewall was that the structural strength of polyethylene was insufficient without additional support. To overcome this drawback, and to ensure sufficient structural strength, it was necessary to mount horizontal supports to the exterior surface, and spray horizontal supports with fiberglass.

In order to have access to the rear surface to accomplish this spraying, and thus solve these two problems, the earth to the rear of the sidewall had to be over-excavating beyond what otherwise would be necessary. After the fiberglass had been sprayed on the exterior surface, the over-excavation was refilled. This process suffered from the disadvantage of increased material and labor costs over what a single interior coating would require.

The present invention ensures sufficient adhesion of the fiberglass and sufficient strength of the sidewall so as to allow for the elimination of the holes, horizontal supports and rear spraying, thus minimizing excavation required, and reducing labor and material costs, while improving quality.

Furthermore, in my prior invention, the upright supports comprised wooden stakes buried in the ground. This material was inexpensive and readily available. However, wood often is not durable, especially in the ground, and may quickly degrade due to weather, insects and other natural forces. As the wood degrades, wood looses supporting properties, eventually offering no support whatsoever to the sidewall. Moreover, decking or other heavy material placed about the perimeter of the completed pool required continued support throughout the life of the pool. In addition, the upright supports needed to be sprayed with fiberglass from the rear, creating the over-excavation problem described above.

The present invention introduces vertical supports specifically designed for the swimming pool. The vertical supports are easy to install and offer superior supporting qualities, and do not degrade. Moreover, the sidewall is reinforced further so that decking or other weighty material placed about the periphery of the pool is easily supported. In addition, no rear spraying, and therefore no over-excavation is required. These improvements result in lower labor and material costs, and a higher quality product.

Therefore it is an object of this invention to provide an improved swimming pool apparatus which overcomes the deficiencies of the prior art devices and provides a new apparatus and method of making a swimming pool of lower cost with the reliability and durability commensurate with a cementitious pool.

Another object of this invention is to provide a swimming pool apparatus wherein the materials of construction do not limited the size or shape of the swimming pools.

Another object of this invention is to provide an improved swimming pool apparatus wherein the sidewall allows the sprayed interior coating to adhere readily, thereby requiring no additional devices for mechanically affixing interior coating to sidewall.

Another object of this invention is to provide an improved swimming pool apparatus wherein the sidewall provides a mechanical strength equivalent to a cementitious pool without additional mechanical reinforcement.

Another object of this invention is to provide an improved swimming pool apparatus which minimizes the amount of excavation required during construction.

Another object of this invention is to provide an improved swimming pool apparatus comprising no components which will readily degrade, even under adverse conditions.

Another object of this invention is to provide an improved swimming pool apparatus which can readily support decking or other weighty material placed about the periphery of the pool.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved swimming pool apparatus, comprising a base extending within a peripheral edge with said base being contoured to form the bottom of the pool. Preferably, the base comprises a cementitious material and is supported by ground soil.

A sidewall extends about a peripheral edge of the base. The sidewall has an inner surface facing an interior of the pool, and an outer surface facing an exterior of the pool. An inner coating, preferably fiberglass, is disposed on the inner surface of the sidewall and on the base for affixing the sidewall to the base and for forming an interior surface for the pool.

The sidewall comprises a plurality of flexible panels. Preferably, each flexible panel is fiberglass, and comprises a plurality of vertical ribs, which enable each flexible panel to flex in a horizontal direction and which inhibit each flexible panels from flexing in a vertical direction. The flexible panels define a plurality of vertical joints.

A plurality of upright supports are affixed to the outer surface of the sidewall at the vertical joints, preferably by fastening means extending through the sidewall and into the upright supports. The upright supports preferably extend into the ground soil.

A plurality of contour panels are affixed to the outer surface of the sidewall proximate the vertical joints and define a plurality of cavities therebetween. The cavities contain the upright supports. Preferably, each contour panel is affixed to each of two flexible panels by mounting means extending through the sidewall and into contour panels.

A plurality of vertical support columns are molded within the cavities for supporting the sidewall and integrally joining the flexible panels. Preferably, the vertical support columns comprise a cementitious material, and are integrally molded with the base.

The invention is also incorporated into the method of making an in ground swimming pool, comprising the steps of excavating a hole in the ground in the shape and the depth of the desired pool. A plurality of upright supports are installed into the ground about the periphery of the excavated hole. A plurality of flexible panels are affixed to the plurality of upright supports for defining the sidewall of the pool. Preferably, two flexible panels are affixed to each of the upright supports. A plurality of contour panels are affixed to the sidewall of the pool for defining a plurality of cavities therebetween. Preferably, each contour panel is affixed to two flexible panels. A cementitious base is poured within the sidewall sheet to form the bottom of the pool. A fiberglass coating is applied on an inner surface of the sidewall and is applied on the cementitious base for affixing the sidewall to the cementitious base and for forming an interior surface for the pool. A plurality of cementitious vertical support columns are poured within the cavities for supporting the sidewall and integrally joining the flexible panels. The preferred method also includes the step of pouring a cementitious footer without the sidewall for integrally molding the cementitious support columns to the cementitious base.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
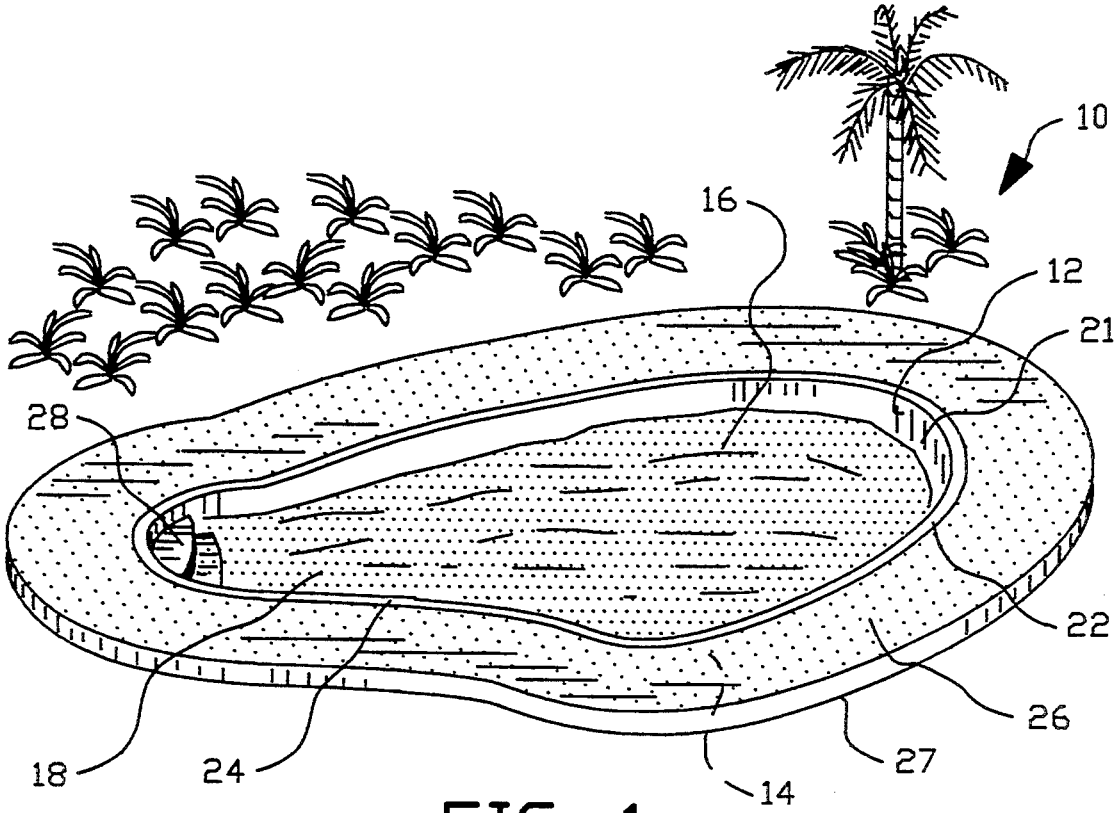
FIG. 1 is an isometric view of an in ground pool made in accordance with the present invention.

FIG. 1 is an isometric view of an in ground pool 10 constructed in accordance with the present invention. The pool 10 includes a sidewall 12 and a base 14 for defining an interior volume 16. The interior volume 16 of the pool 10 receives water 18 in a conventional manner. The sidewall 12 comprises an inner surface 21 and an outer surface 22 for defining a pool perimeter 24. A concrete slab 26 supported by an upper surface of the ground 27 engages with the pool perimeter 24. The pool 10 is shown having interior steps 28 descending from the pool perimeter 24 into the interior volume 16 of the pool 10 for facilitating the entrance and exit from the pool 10.

Figure 2:
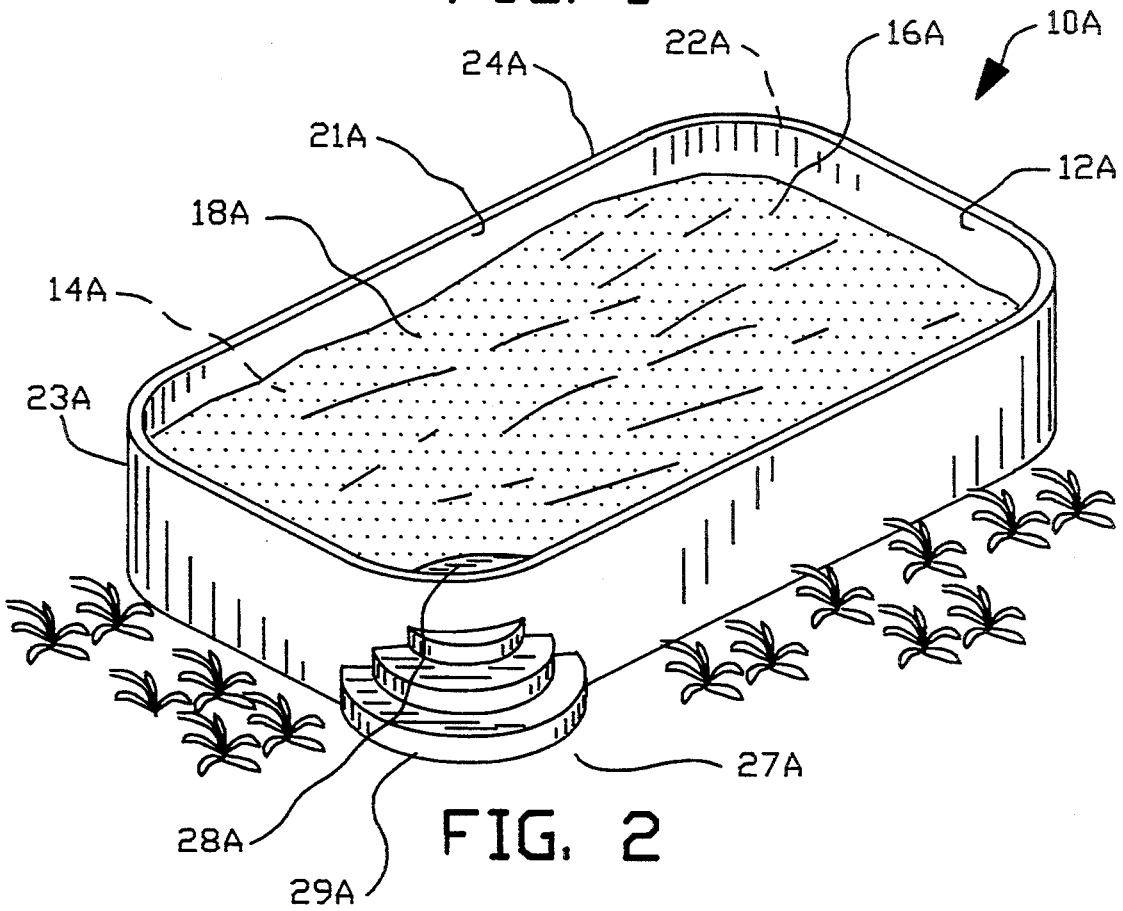
FIG. 2 is an isometric view of an above ground pool made in accordance with the present invention.

FIG. 2 is an isometric view of an above ground pool 10A constructed in accordance with the present invention. The pool 10A includes a sidewall 12A and a base 14A for defining an interior volume 16A. The interior volume 16A of the pool 10A receives water 18A in a conventional manner. The sidewall 12A comprises an inner surface 21A, an outer surface 22A and an optional external surface 23A for defining a pool perimeter 24A. The pool 10A is shown having interior steps 28A descending from the pool perimeter 24A into the interior volume 16A of the pool 10A as well as exterior steps ascending from the an upper surface of the ground 27A to the pool perimeter 24A for facilitating the entrance and exit for the pool 10A.

Although the pools 10 and 10A of FIGS. 1 and 2 appear to resemble conventional pools, the pools 10 and 10A of the present invention are structurally unique and are constructed in a manner different from the pools heretofore known by the prior art. Furthermore, although the pools 10 and 10A have been shown to be swimming pools of limited size, it should be appreciated by those skilled in the art that the present invention is applicable to swimming pools of unlimited size as well as spa pools and the like.

Figure 3:
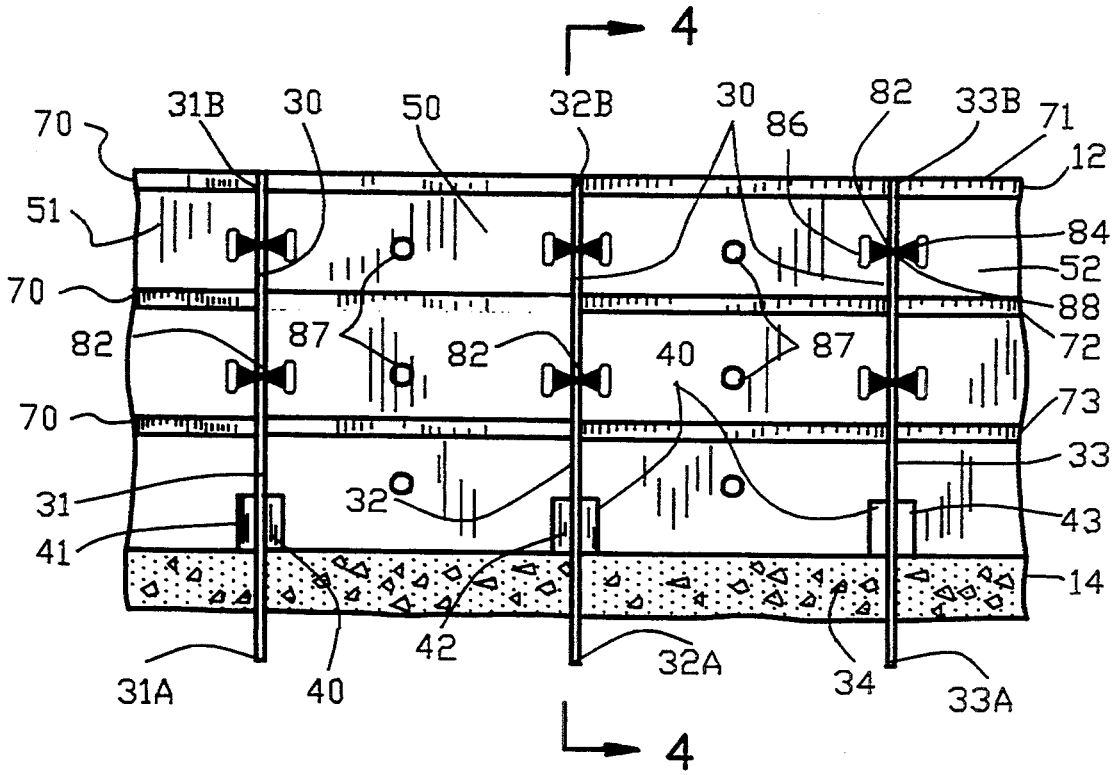
FIG. 3 is an polyethylene view of a section of an outer surface of the pool of FIG. 1 prior to an inner coating and an outer coating.
Figure 4:
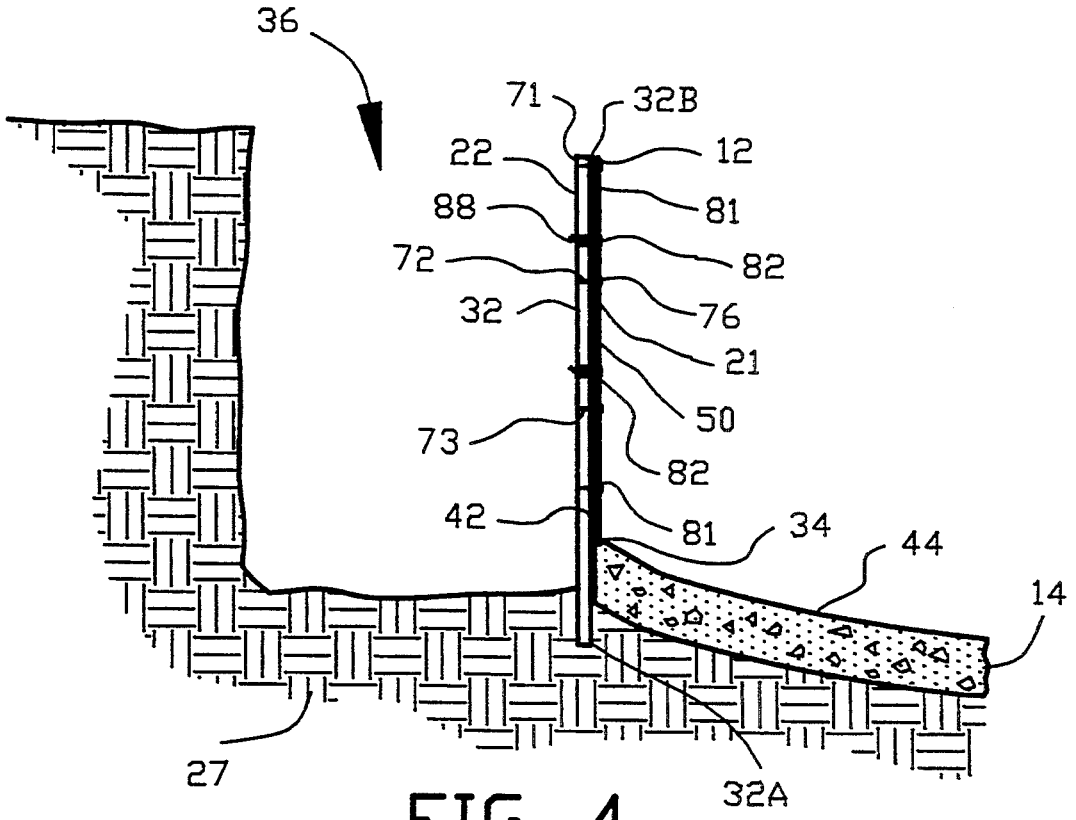
FIG. 4 is a side sectional view along line 4—4 in FIG. 3 prior to the inner coating and the outer coating.
Figure 5:
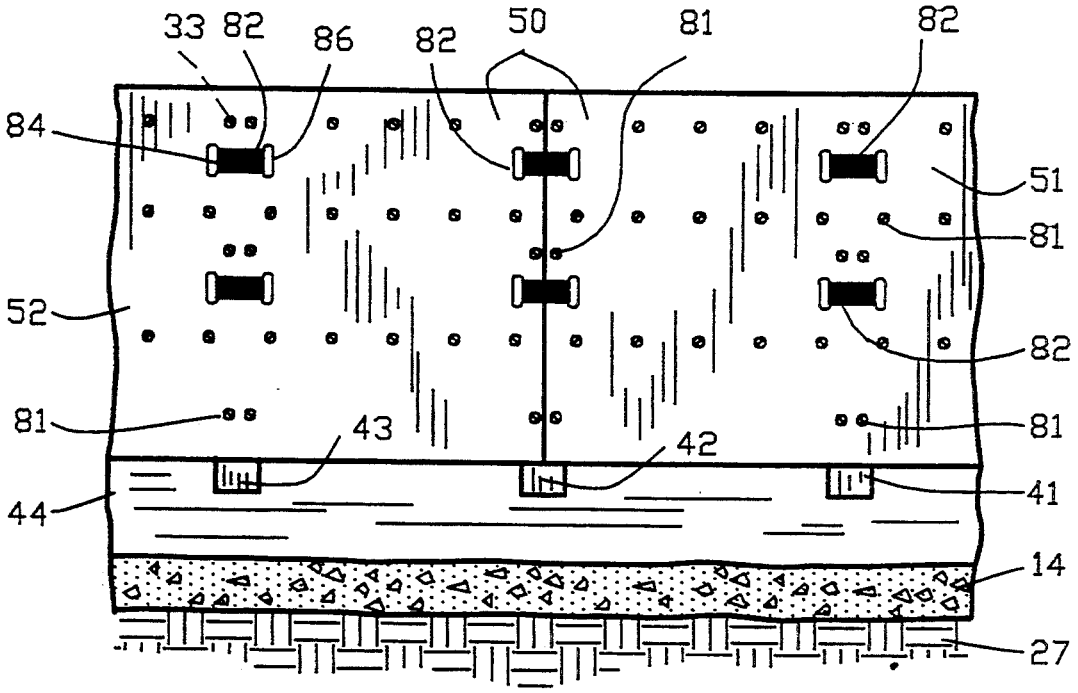
FIG. 5 is an polyethylene view of a section of an inner surface of the pool of FIG. 1 prior to an application of the inner coating and the outer coating.

FIG. 3 is an enlarged view illustrating the outer surface 22 of the sidewall 12 of the pool 10 of FIG. 1. FIG. 4 is a sectional view along line 4—4 in FIG. 3 whereas FIG. 5 is an enlarged view illustrating the inner surface 21 of the sidewall 12 of the pool 10 of FIG. 1.

Preferably, the base 14 is constructed of a cementitious material such as concrete and is contoured to form the bottom and partial sidewall of the pool 10 in an excavation. However, it should be understood that various other material may be used for forming the base 14 such as a polymeric material and the like.

Figure 6:
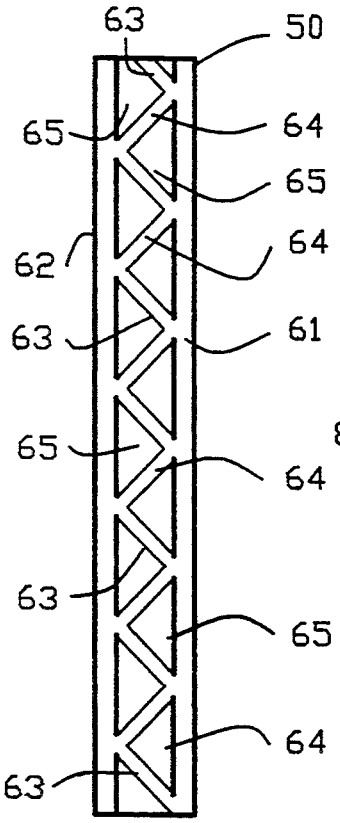
FIG. 6 is an enlarged view of FIG. 4.

As best shown in FIGS. 3, 4 and 6, a plurality of upright supports 30 including a first, a second and a third upright support 31–33 have lower ends 31A–33A thereof extend into the ground 27 adjacent a peripheral edge 34 of the base 14. Preferably, the upright supports 31–33 extend into the ground 27 a distance sufficient that upper ends 31B–33B of the upright supports 31–33 are in a constant height relationship.

The upright supports 30 may be constructed from various materials including wood, metal or polymeric materials. In order to facilitate the construction of the pool 10, a construction trench 36 is shown excavated about the peripheral edge 34 of the base 14.

A plurality of base coupling means 40 including first, second and third base coupling means 41–43 are disposed adjacent to the first, second and third upright members 31–33 and extend over an upper surface 44 of the base 14. Preferably, the base coupling means 40 are constructed of a flexible fiberglass web or fiberglass cloth. The securing of the first, second and third base coupling means 41–43 to the first, second and third upright members 31–33 will be discussed in greater detail hereinafter.

Sidewall sheet means 50 including a first and a second sidewall sheet 51 and 52 are disposed between the peripheral edge 34 of the base 14 and the plurality of upright supports 30. The first and second sidewall sheets 51 and 52 define the inner surface 21 facing the interior volume 16 of the pool 10 and define the outer surface 22 of the pool 10 facing the exterior of the pool 10.

Preferably, the sidewall sheet means 50 is a flexible polymeric material that may be transported in rolls. The sidewall sheet means 50 should have a width of one to two meters and a length sufficient to be easily transported in sheets while minimizing the number of seams such as seam 53 between the first and second sidewall sheets 51 and 52 as shown in FIG. 5.

Figure 7:
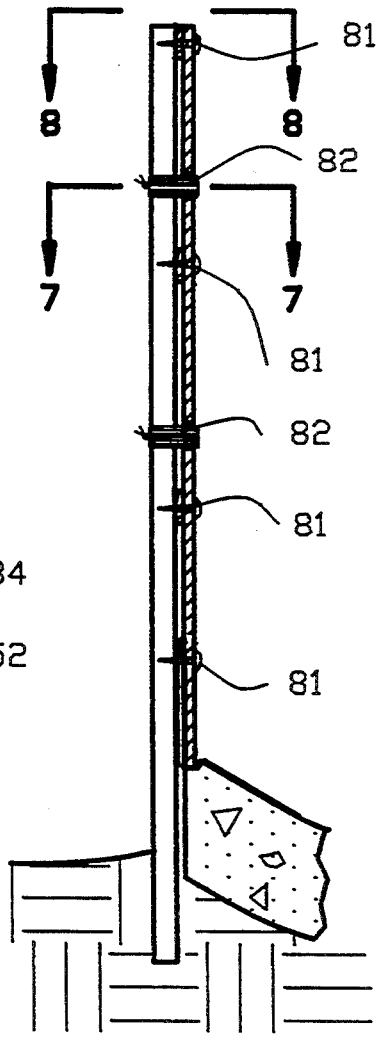
FIG. 7 is an enlarged partial view along line 7—7 in FIG. 6.

FIG. 7 is an enlarged top view along line 7—7 in FIG. 6 illustrating a preferred material for the sidewall sheet means 50. The sidewall sheet means 50 comprises a sheet of flexible plastic material having an inner sheet 61 and an outer sheet 62 with a plurality of parallel interconnecting sheet elements 63 and 64 securing the inner sheet 61 to the outer sheet 62. The interconnecting sheet elements 63 and 64 are established in a triangular relationship between the inner and outer sheets 61 and 62 for creating triangular voids 65.

The plurality of parallel interconnecting sheet elements 63 and 64 extend in a parallel relationship along the width of the sidewall sheet means 50. The triangular relationship of the plurality of parallel interconnecting sheet elements 63 and 64 enable the sidewall sheet means 50 to flex in a horizontal direction or flex in a direction along or parallel to the parallel interconnecting sheet elements 63 and 64. Simultaneously therewith, the triangular relationship of the plurality of parallel interconnecting sheet elements 63 and 64 inhibit the sidewall sheet means 50 from flexing in a vertical direction or flexing in a direction perpendicular to the parallel interconnecting sheet elements 63 and 64.

The preferred flexing property of the sidewall sheet means 50 enables the sidewall sheet means 50 to be easily formed for the corners of the pool 10 as shown in FIG. 1. However, the preferred flexing property of the sidewall sheet means 50 inhibits the sidewall sheet means 50 from expanding outwardly under the hydraulic force produced by the water 18 within the pool 10. Concomitantly therewith, the preferred flexing property of the sidewall sheet means 50 inhibits the sidewall sheet means 50 from expanding inwardly under the hydraulic force of water within the ground 27 when the water 18 is removed from the pool 10. The triangular voids 65 also provide an air space to add insulation for heated swimming pools or spa pools. Although the sidewall sheet means 50 has been described with reference to a preferred material, it should be understood that various types of material may be utilized for the construction of the sidewall sheets means 50 in the present invention.

The present invention includes horizontal support means 70 including an upper horizontal support 71, an intermediate horizontal support 72 and a lower horizontal support 72. The horizontal support means 70 may be temporarily secured to the inner sheet 61 of the sidewall sheet means 50 by adhesive means or mechanical fasteners. The horizontal support means 70 are disposed between the sidewall sheet means 50 and upright supports 30 as best shown in FIG. 6. Although many types of material can be utilized for the horizontal support means, it has been found the masonite in a thickness of approximately 0.25 inches is suitable for use with the present invention.

Preferably, the horizontal support means 70 are first initially secured to the sidewall sheet means 50 by an adhesive and then permanently secured to the sidewall sheet means 50 by mechanical fasteners shown as screws 76.

After the horizontal support means 70 have been secured to the sidewall sheet means 50, the sidewall sheet means 50 is then affixed to the plurality of upright supports 30. The present invention includes affixing means 80 for affixing the sidewall sheet means 50 to the plurality of upright supports 30. Specifically, the affixing means 80 includes first affixing means 81 and second affixing means 82.

As best shown in FIGS. 5 and 6, the first affixing means 81 is shown as a plurality of screws extending through the sidewall sheet means 50 into the plurality of upright supports 30. In some instances, the screws of the first affixing means 81 extend through the horizontal support means 70 and into the plurality of upright supports 30 creating a space 83 between the sidewall sheet means 50 into the plurality of upright supports 30. When the first affixing means 81 extends directly from the sidewall sheet means 50 into the plurality of upright supports 30, the first affixing means 81 closes the space 83 between the sidewall sheet means 50 into the plurality of upright supports 30.

The base coupling means 40 are inserted in the space 83 between the sidewall sheet means 50 and the upright supports 30. The screws of the first affixing means 81 extend through sidewall sheet means 50 and through the base coupling means 40 into the upright supports 30 for securing the base coupling means 40.

Figure 8:
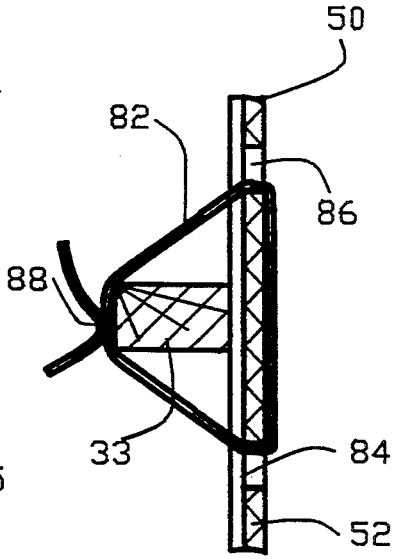
FIG. 8 is an enlarged sectional view along line 8—8 in FIG. 6.

The second affixing means 82 is shown in FIG. 8 as a flexible fiberglass web or fiberglass rope extending through a first and a second hole 84 and 86 in the sidewall sheet means 50 and extending about the upright support 32 and secured by suitable means. In this embodiment, the flexible fiberglass web or fiberglass rope is secured by a knot 88. Optionally, a plurality of third holes 87 may be defined throughout the sidewall sheet means 50 in a pattern or at random the function of which will become apparent hereinafter.

An important aspect of the present invention is the application of coating means 90 to the sidewall sheet means 50. More specifically, the coating means 90 comprises an inner coating 91 and an outer coating 92. The inner coating 91 provides a liquid tight seal as well as an aesthetic appearance to the inside surface 21 of the pool 10. The outer coating 92 provides mechanical strength to the sidewall sheet means 50.

Figure 9:
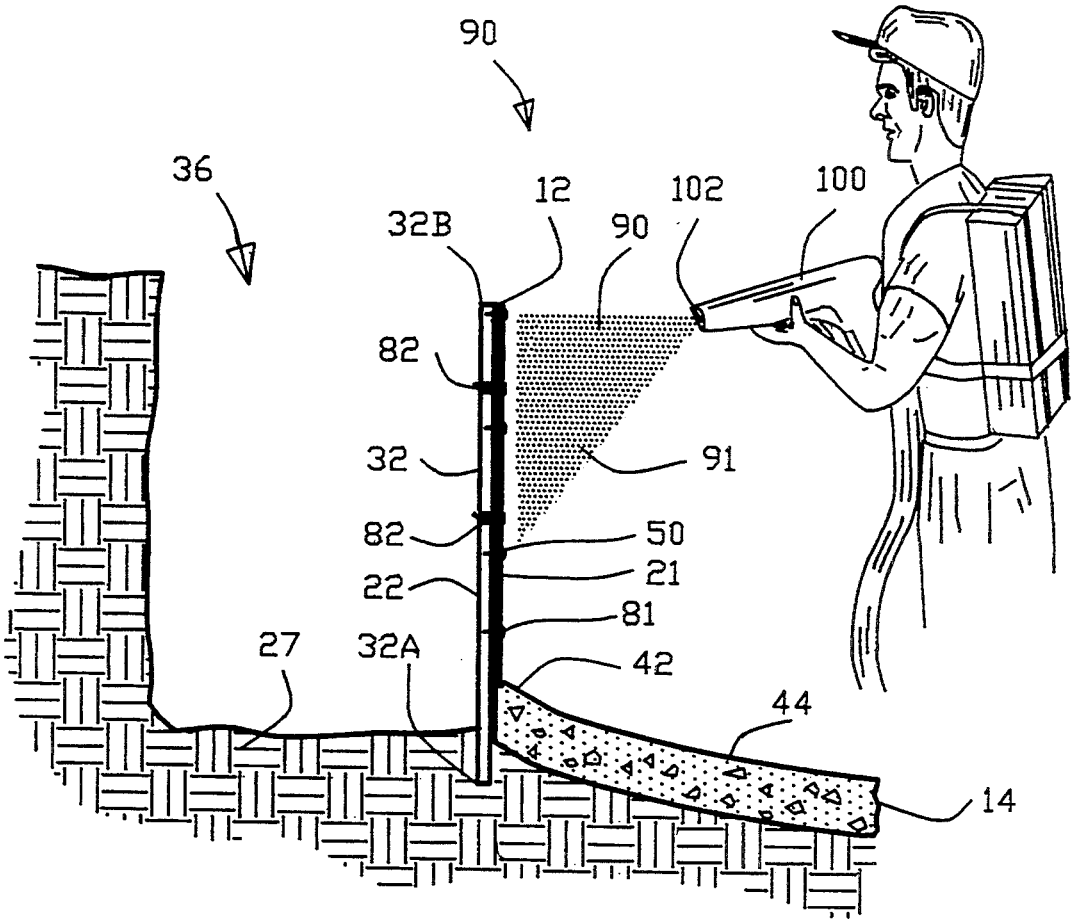
FIG. 9 is a side sectional view similar to FIG. 4 illustrating the spraying of the inner coating on a section of the inner surface of the pool of FIG. 1.

FIG. 9 illustrates the application of the inner coating 91 to the inner surface 21 of the sidewall means 50 as well as to the base 14 through the use of a spray gun 100. Preferably, the inner and outer coatings 91 and 92 are a polymeric resin and hardener simultaneously applied with chopped fiberglass strands ejected from a plurality of nozzles 102 of the coating gun 100. The coating gun 100 this type is commonly referred to as a "chopper gun" and is widely used in the industry.

Figure 10:
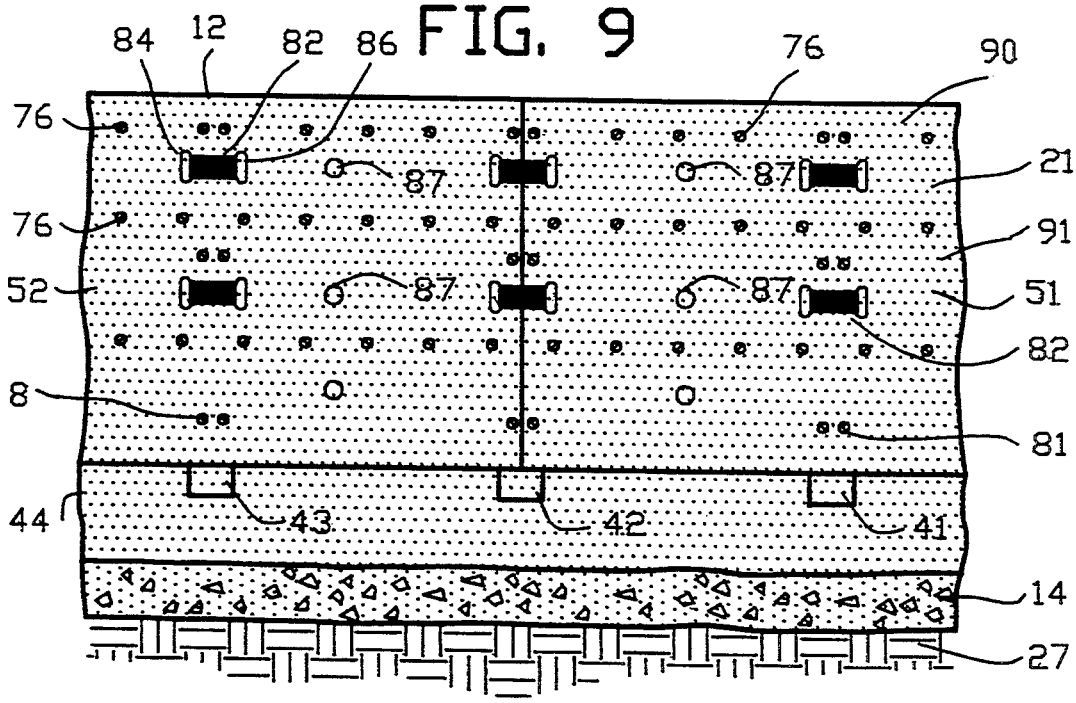
FIG. 10 is an polyethylene view similar to FIG. 5 illustrating the section of the inner surface of the pool of FIG. 1 with the inner coating.

FIG. 10 illustrates the inner surface 21 of the sidewall sheet means 50 with the inner coating 91 affixed thereto. The inner coating 91 is applied in a thickness sufficient to cover the screws 76 and as well as to cover the first and second affixing means 81 and 82. The inner coating 91 also bonds the base coupling means 40 to the upper surface 44 of base 14. The thickness of the inner coating 91 is of sufficient thickness to cover the base coupling means 40 and provides a smooth contour for the base 14. In addition, the inner coating provides a water tight seal as well as an aesthetic appearance to the interior volume 16 of the pool 10.

Figure 11:
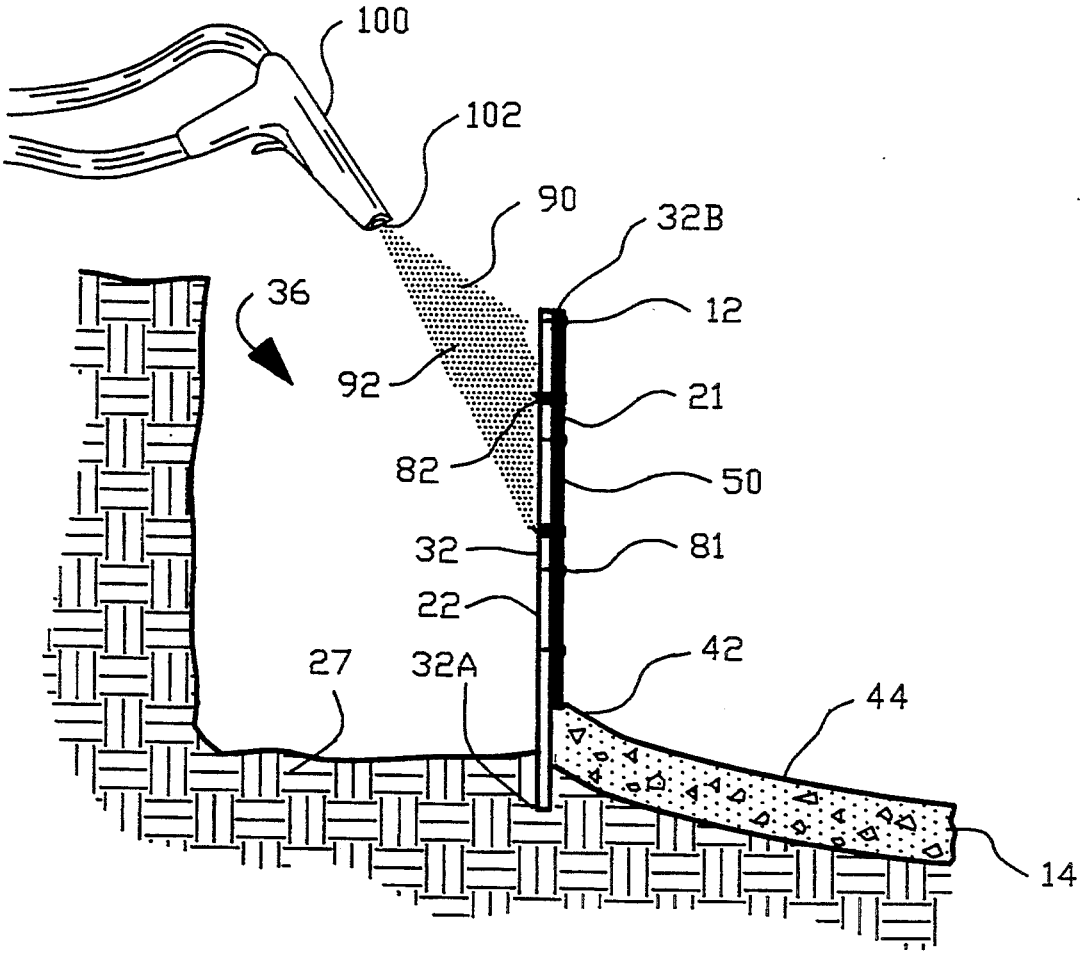
FIG. 11 is a side sectional view similar to FIG. 4 illustrating the spraying of the outer coating on a section of the outer surface of the pool of FIG. 1.
Figure 12:
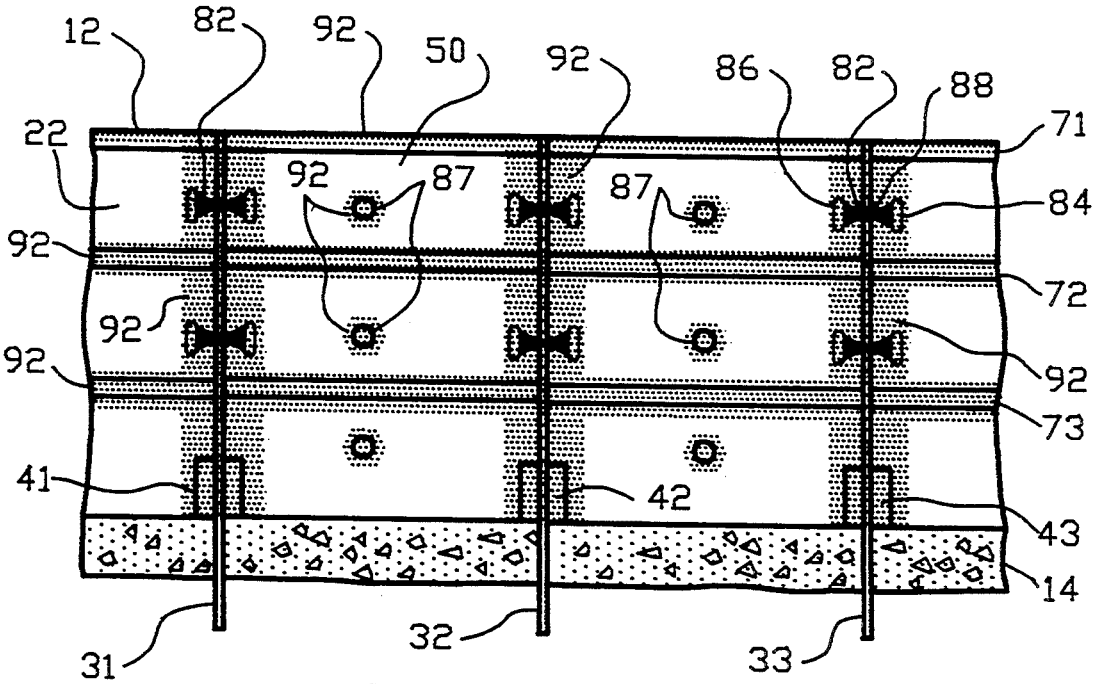
FIG. 12 is an polyethylene view similar to FIG. 3 illustrating the section of the outer surface of the pool of FIG. 1 with the outer coating.

FIG. 11 illustrates the coating gun 100 applying the outer coating 92 to the outer surface 22. As can be seen from FIG. 12, the outer coating 92 is applied only to selected areas of the outer surface 22. Specifically, the outer coating 92 is applied to the outer surface 22 in proximity to the upright supports 30, the base coupling means 40 and the horizontal support means 70. The outer coating 92 also covers the fiberglass web or cord of the second affixing means 82 as well as the area proximate the third holes 87. The outer coating 92 substantially increases the mechanical strength of the sidewall sheet means 50 to provide superior strength heretofore unknown in the prior art.

Figure 13:
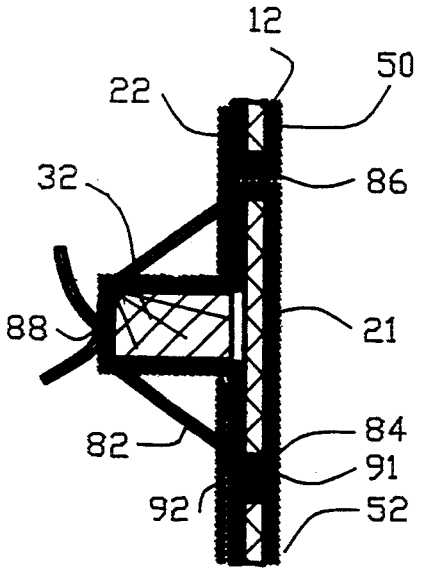
FIG. 13 is a sectional view similar to FIG. 8 illustrating the inner coating and the outer coating.

FIG. 13 is a view similar to FIG. 8 after the application of the inner and outer coatings 91 and 92. The inner coating 92 forms a U-shaped channel about the upright support 32 which functions as a mechanical beam to add mechanical strength to the sidewall sheet means 50. Furthermore, the inner coating 91 is integrally bonded directly to the outer coating 92 through the first and second holes 84 and 86 upon the curing of the inner and outer coatings 91 and 92.

Figure 14:
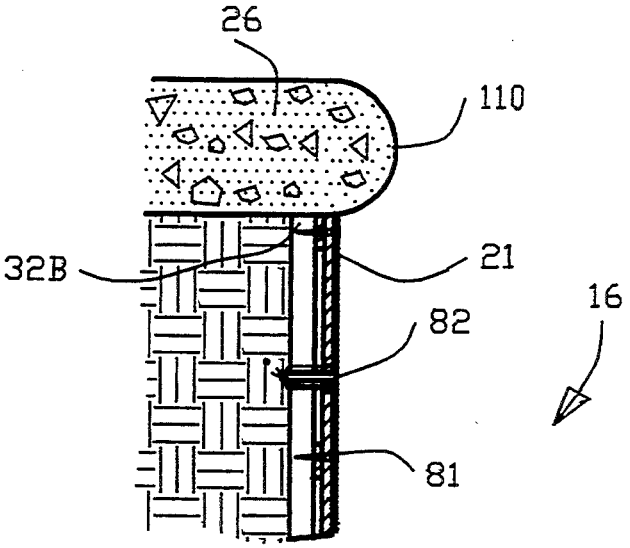
FIG. 14 is an enlarged sectional view illustrating a bonding of the inner coating.
Figure 14:
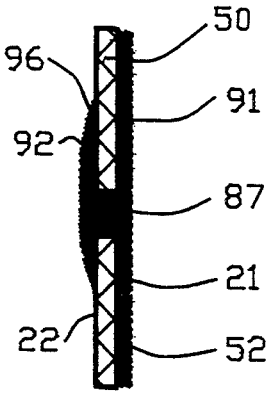

FIG. 14 illustrates the inner coating 91 extending through one of the plurality of the third holes 87. A region 96 of the outer coating 92 has been applied to the outer surface and extends through the third hole 87 to bond directly to the inner coating 91. In many cases, a fiberglass coating does not readily adhere to certain types of polymeric material. Accordingly, the plurality of third holes 87 function to mechanically fasten the inner coating 91 to the sidewall sheet means 50. The region 96 of the outer coating 92 mechanically secures the inner coating 91 to the sidewall sheet means 50 through the third hole 87 to inhibit delamination of the inner coating 91 from the sidewall sheet means 50.

Figure 15:
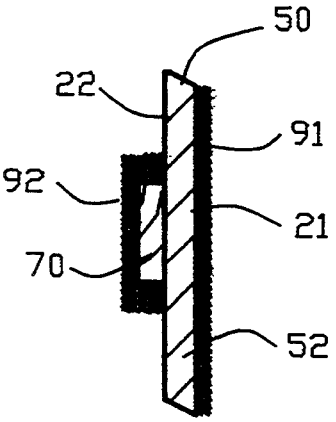
FIG. 15 is an enlarged sectional view illustrating the outer coating covering a horizontal support means.

FIG. 15 illustrates the outer coating 92 forming a U-shaped beam about the horizontal support means 70. This U-shaped beam is similar to the beam shown with reference to FIG. 13. The U-shaped beam formed about the horizontal support means 70 functions as a mechanical beam to add mechanical strength to the sidewall sheet means 50. The U-shaped beams formed by the outer coating 92 provides both vertical and horizontal stability to the sidewall sheet means 50 as well as integrally bonding the outer coating 92 to the inner coating 91.

Figure 16:
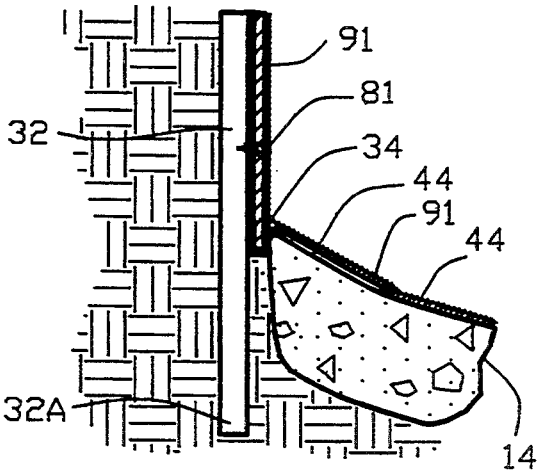
FIG. 16 is an enlarged side sectional view similar to FIGS. 9 and 11 illustrating a slab for forming a lip of the pool.

FIG. 16 illustrates the final completion of the sidewall wherein the trench 36 has been filled with ground soil 27 and the slab 26 has been poured to engage with the sidewall 12. The slab 26 is prepared in a conventional manner with an overhang 110 being constructed through the use of a form (not shown).

Figure 17:
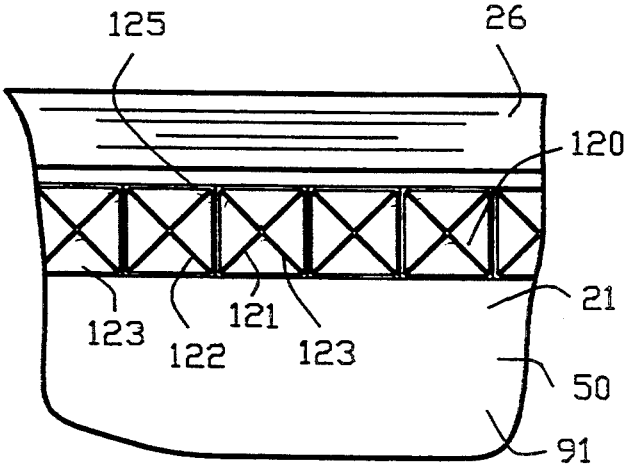
FIG. 17 is an enlarged polyethylene view of a design on the inner coating.
Figure 18:
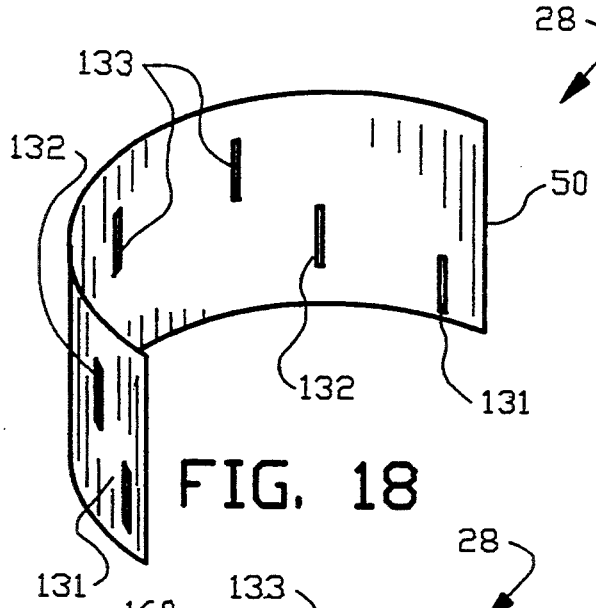
FIG. 18 is an isometric view of a section of the pool of FIG. 1 illustrating slots for forming pool steps.
Figure 19:
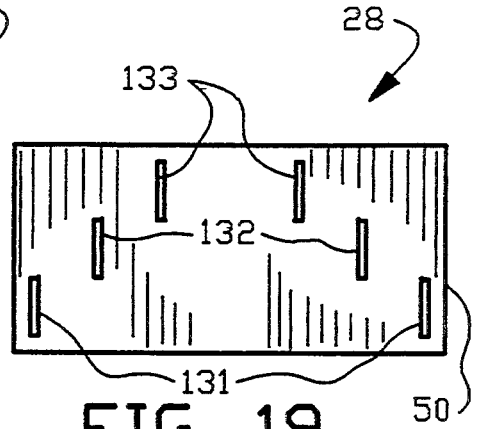
FIG. 19 is a front polyethylene view of FIG. 18.

FIG. 17 is a front partial view of the inner surface 21 illustrating a decoration 120 applied adjacent the slab 26. This optional decoration 120 may be formed by applying a masking tape (not shown) to the areas 121–125 and painting the decoration 120 thereon. After the paint is dried, the masking tape is removed and the decoration 120 appears as a tile extending about the inner surface 21 of the pool 10 adjacent the slab 26. It should be appreciated that various types and designs of decorations may be applied with the practice of the present invention.

FIGS. 18–23 illustrate the forming of the interior steps 28 of the pool 10. The sidewall 50 is provided with paired slots 131–133 for receiving a plurality of step sidewalls 141–143. The step sidewalls 141–143 are preferably formed of the same material as the sidewall sheet means 50.

Figure 20:
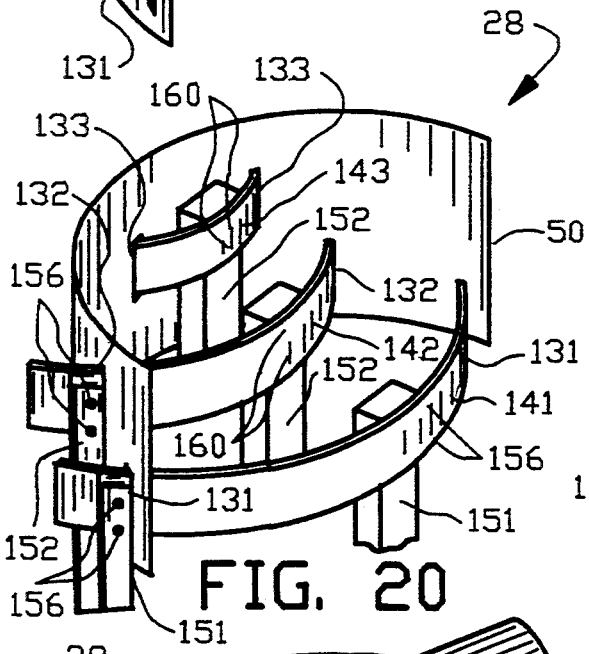
FIG. 20 is an isometric view similar to FIG. 18 illustrating a step sidewall sheet extending through the slots for forming pool steps.
Figure 21:
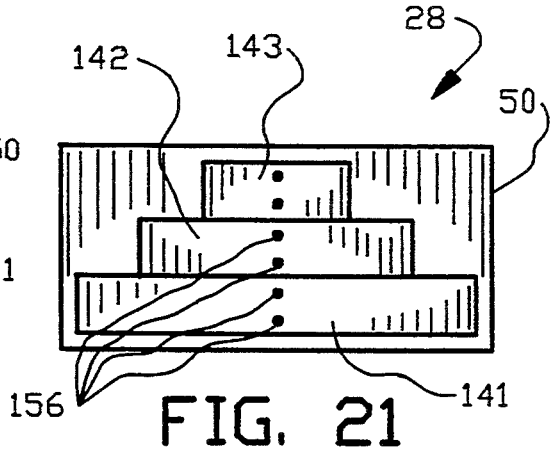
FIG. 21 is a front polyethylene view of FIG. 20.

FIGS. 20 and 21 illustrate the step sidewalls 141–143 extending through the slots 131–133, respectively, and being supported by a plurality of upright supports 151–153. A plurality of screws 156 affix the step sidewalls 141–143 to the sidewall 50, as well as affixing the step sidewalls 141–143 to the upright supports 151–153.

Figure 22:
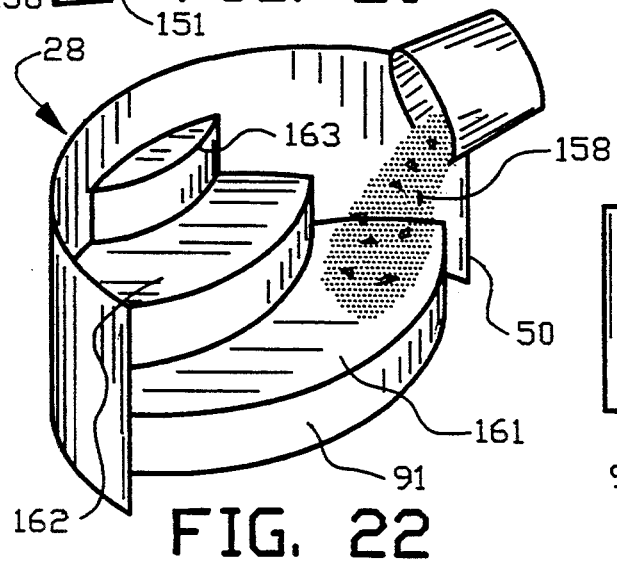
FIG. 22 is an isometric view similar to FIG. 20 illustrating a cementitious material disposed within the step sidewall sheet for forming pool steps.
Figure 23:
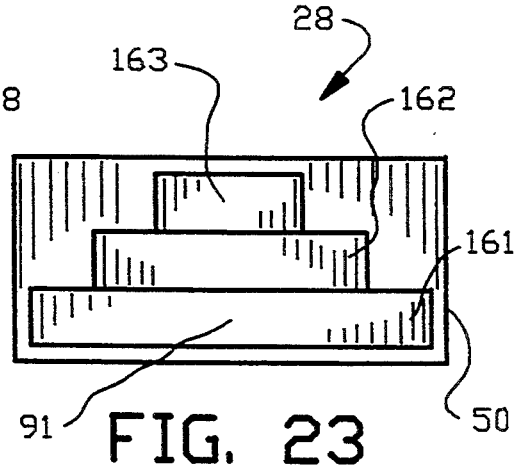
FIG. 23 is a front polyethylene view of FIG. 22.

FIGS. 22–23 illustrate a cementitious material 158 being introduced within the adjacent step sidewalls 141–143 to form the steps 161–163. The steps 161–163 are then covered by the inner coating 91.

Figure 24:
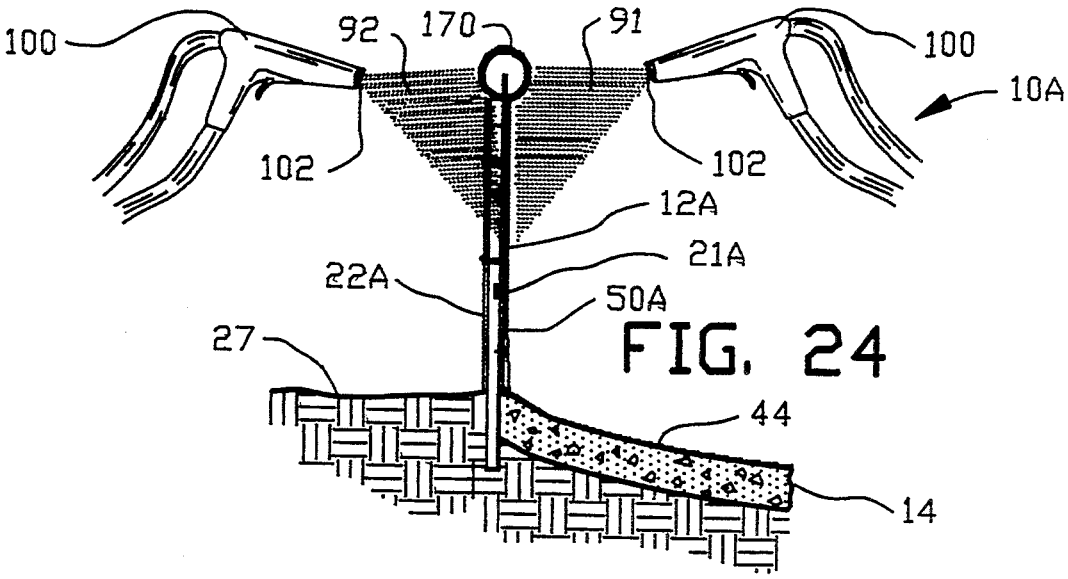
FIG. 24 is a side sectional view of a portion of the above ground pool of FIG. 2 illustrating the spraying of an inner coating and an outer coating.
Figure 25:
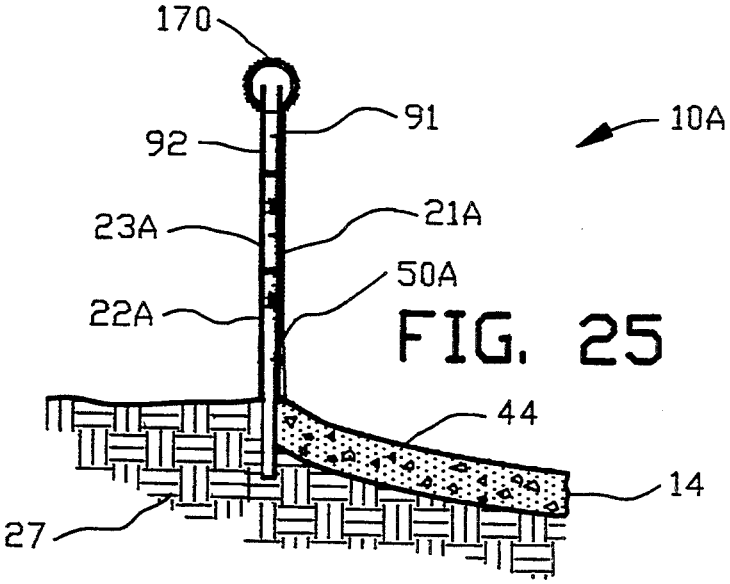
FIG. 25 is a side sectional view similar to FIG. 24 illustrating the securing of an exterior wall sheet.
Figure 26:
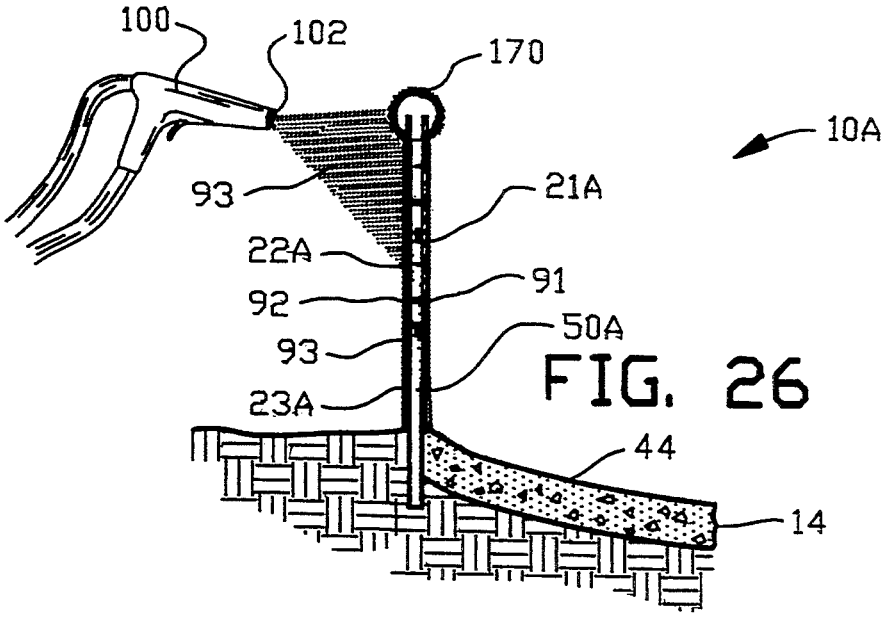
FIG. 26 is a side sectional view similar to FIG. 25 illustrating the spraying of an exterior coating on the exterior wall sheet.

FIGS. 24–26 illustrate a sidewall 12A of the above ground pool illustrated in FIG. 2. The sidewall 12A comprises sidewall sheet means 50A erected in a manner identical to the in ground pool 10 set forth with reference to FIGS. 1–23. In this embodiment, a flexible tubing 170 is affixed to the sidewall 12A. The sidewall sheet means 50A is coated with the inner and outer coatings 91 and 92 as set forth in FIG. 22.

FIG. 25 illustrates an external surface sheet 23A being secured to the sidewall sheet means 50A. Preferably, the external surface sheet 23A constructed of the same material as the sidewall sheet means 50 and is mechanically secured by screws to the sidewall sheet means 50A.

FIG. 26 illustrates an external coating 93 being applied to the external surface 23. The use of the external surface 23 and the external coating 93 provides additional mechanical strength to the above ground pool 10A as well as providing an aesthetic appearance to the external surface 23A.

The invention is also incorporated into the method of making a pool comprising installing a plurality of upright supports into the ground. A sidewall sheet is affixed to the plurality of upright supports for defining the sidewall of the pool. A fiberglass coating is affixed on an inner surface of the sidewall sheet for forming an interior surface for the pool. A fiberglass coating is applied on an outer surface of the sidewall sheet for affixing the sidewall sheet to the plurality of upright supports.

The present invention enables the construction of either an in ground or an above ground pool of unlimited size and superior mechanical strength. As it can be appreciated by those skilled in the art, the pool constructed in accordance with the present invention may be installed in locations with limited access which was heretofore unavailable in the prior art. The costs of pools constructed by the present invention is substantially less than pools constructed by conventional processes. A typical residential swimming pool can be completely finished and filled with water within a 7–10 day period of time.

It has been found that the sidewall 12 of the in ground pool 10 is sufficient in strength to support the adjacent ground 27 without any water 18 being disposed in the pool 10. Accordingly, the trench 36 need not be filled concomitantly with the filling of water 18 into the pool 10 as required by the prior art practices. Accordingly, the pool 10 may be thoroughly cleaned after complete construction of the pool 10 and prior to filling with water 18. It has also been found that the sidewall 12A of the above ground pool 10A show no observable deflection when filled with water 18A.

Figure 27:
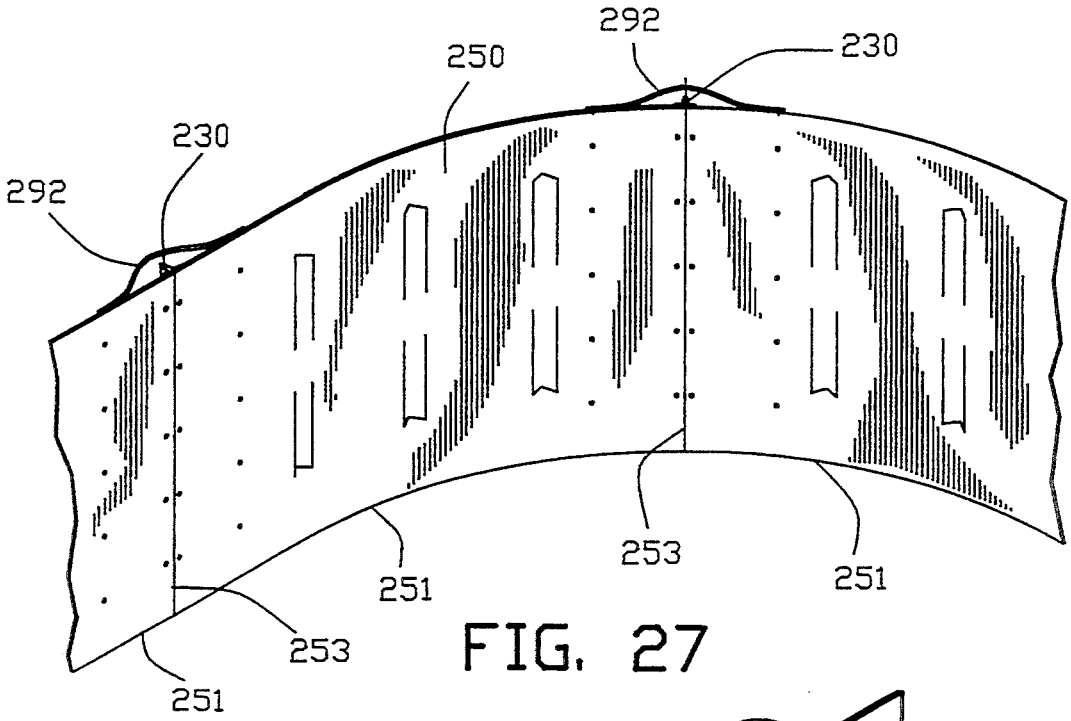
FIG. 27 is a partial isometric view of a second embodiment of the sidewall of the pool of FIG. 1.
Figure 28:
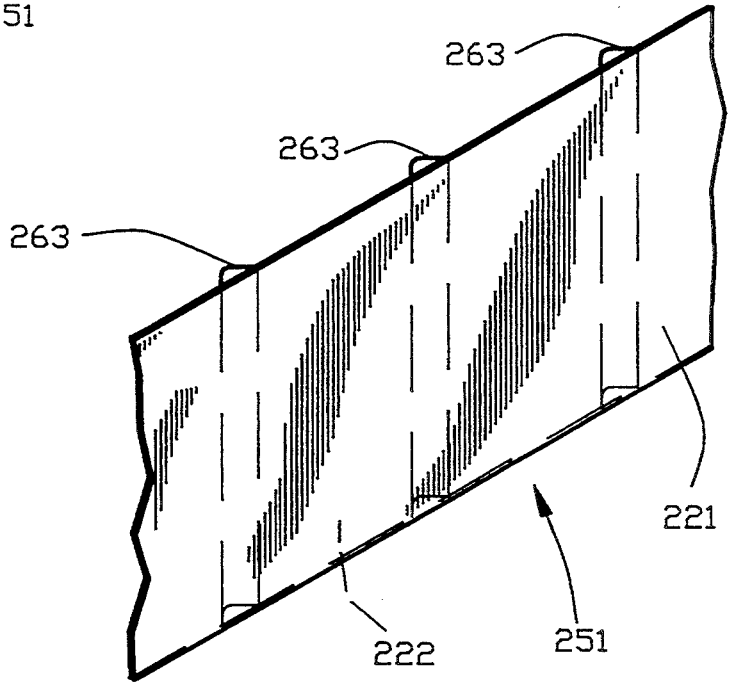
FIG. 28 is an isometric view of one of the flexible panels comprising the second embodiment of the sidewall.
Figure 29:
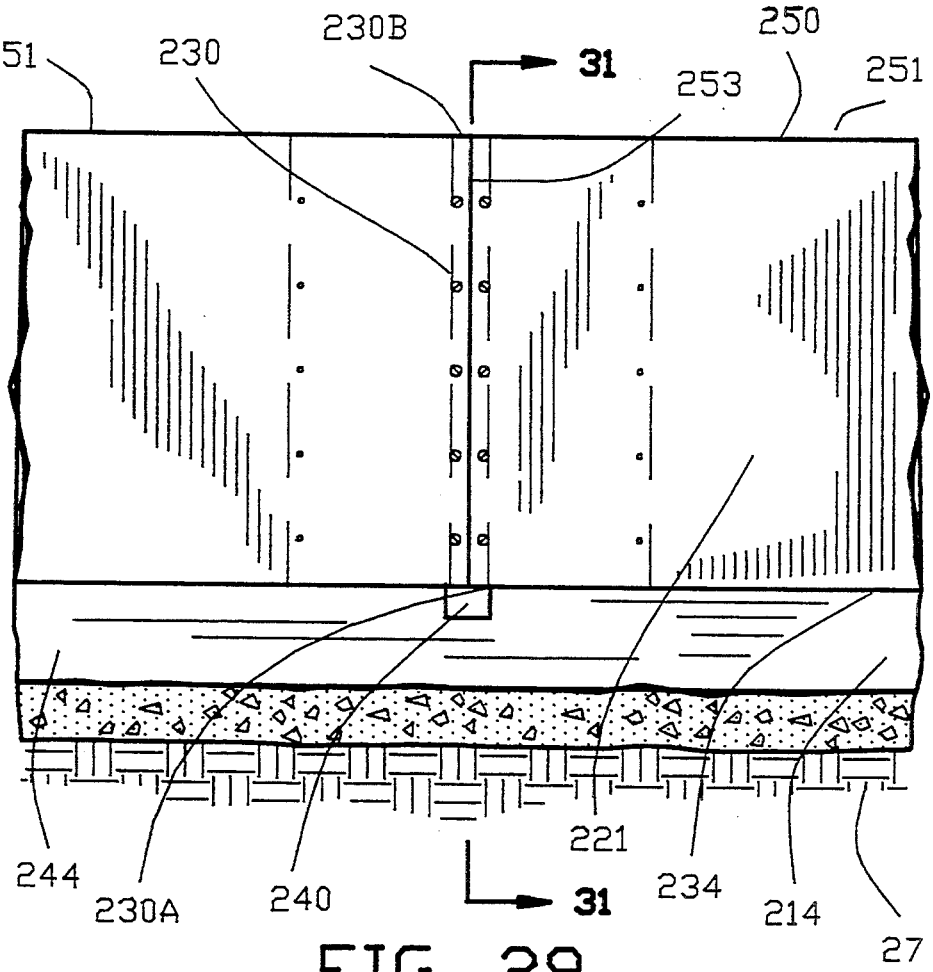
FIG. 29 is an polyethylene view of a section of an inner surface of the second embodiment of the sidewall of FIG. 27 prior to an application of the inner coating.
Figure 30:
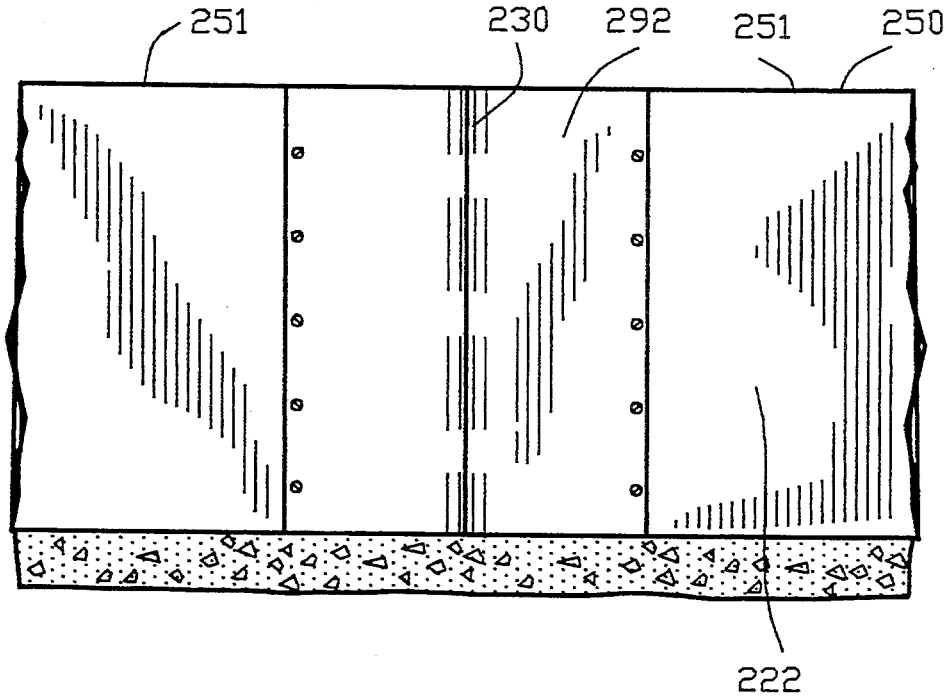
FIG. 30 is an polyethylene view of a section of an outer surface of the second embodiment of the sidewall of FIG. 27.
Figure 31:
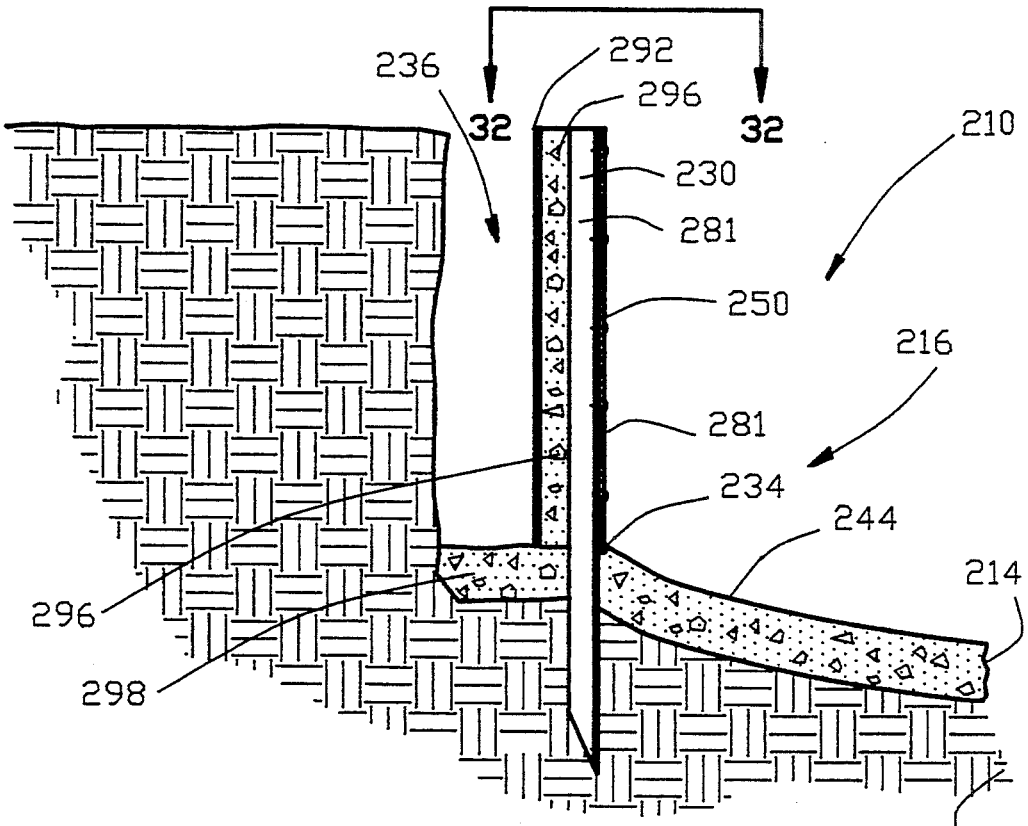
FIG. 31 is a side sectional view along line 31—31 in FIG. 29 prior to an application of the inner coating.
Figure 32:
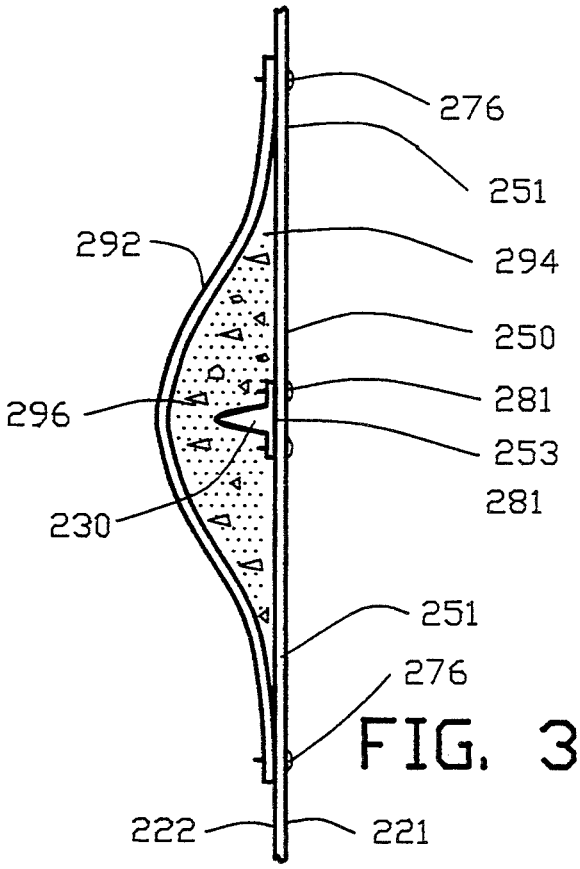
FIG. 32 is an enlarged sectional view along line 32—32 in FIG. 31.
Figure 33:
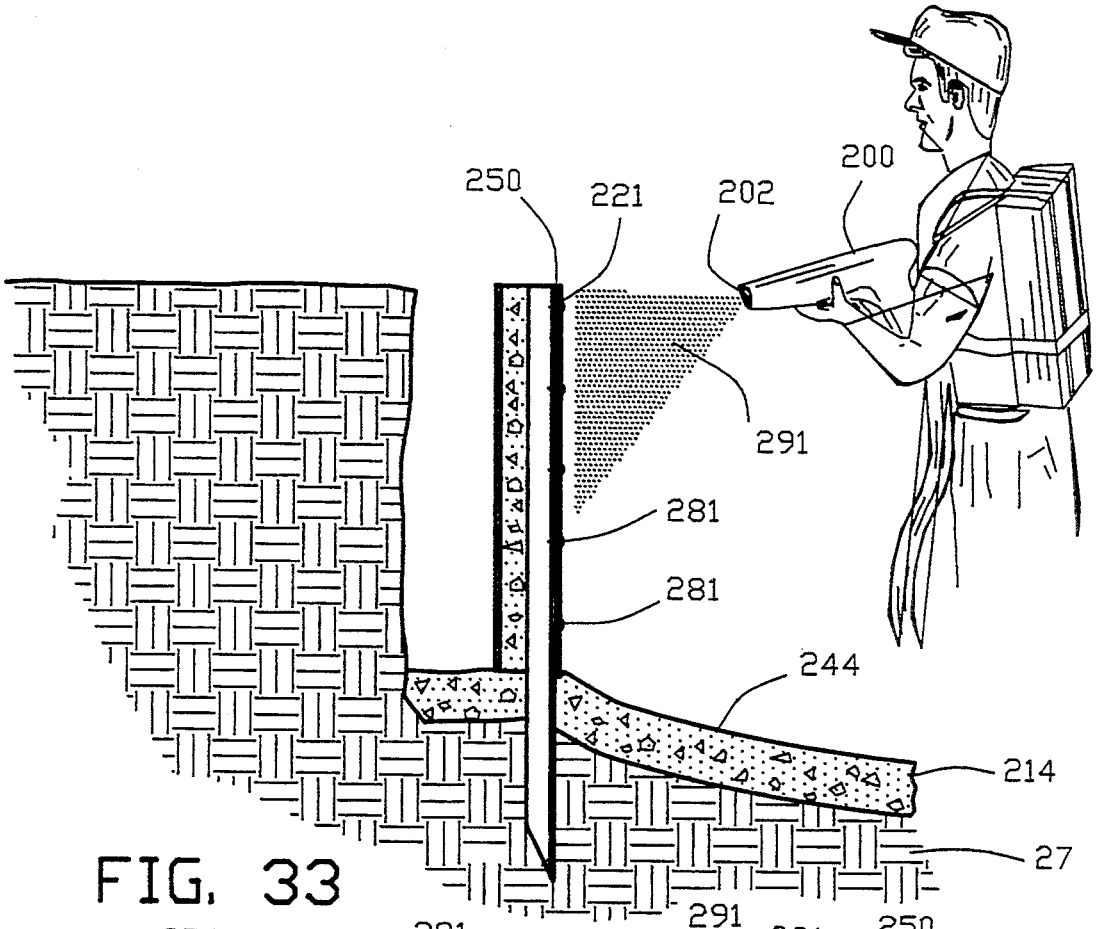
FIG. 33 is a side sectional view similar to FIG. 31 illustrating the spraying of the inner coating on a section of the inner surface of the pool of FIG. 1.
Figure 34:
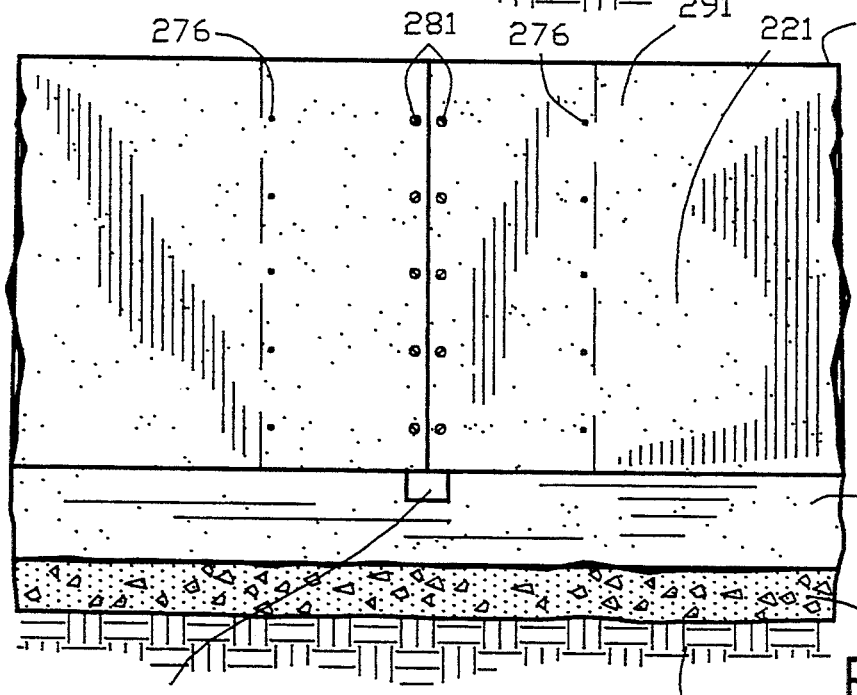
FIG. 34 is an polyethylene view similar to FIG. 29 illustrating the section of the inner surface the second embodiment of FIG. 27 with the inner coating.
Figure 35:
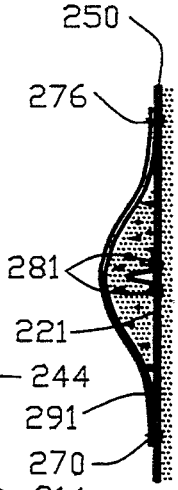
FIG. 35 is a sectional view similar to FIG. 32 illustrating the inner coating.
Figure 36:
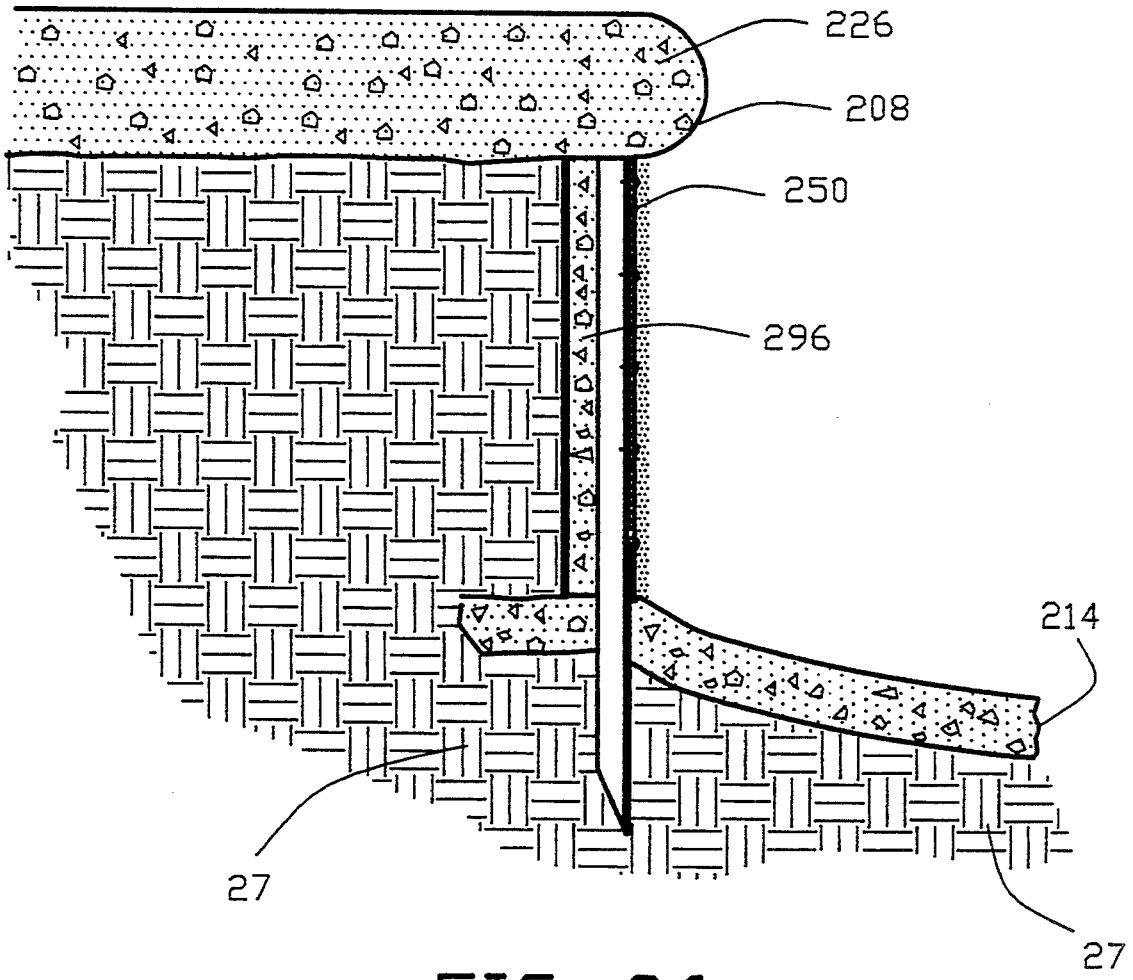
FIG. 36 is an enlarged side sectional view similar to FIG. 31 illustrating a slab for forming a lip of the pool.

FIGS. 27–36 depict a second embodiment of the pool 210 comprising a sidewall 250 fabricated from a plurality of flexible panels 251 mounted on upright supports 230 about a base 214. FIG. 27 shows sidewall 250 comprised of flexible panels 251 abutting one another at joints 253. FIG. 28 shows one of the flexible panels 251. FIGS. 29–32 are front, rear, side and top views of the sidewall 250 assembled about base 214, and supported by pillars 296. FIGS. 33–35 illustrate the application of the coating to the pool 210. FIG. 36 is a partial sectional view of the completed pool 210.

As best shown in FIGS. 27 and 28, sidewall 250 is comprised of a plurality of flexible panels 251, each having an inner surface 221 and an outer surface 222. A plurality of parallel ribs 263 are integrally formed in outer surface 222, and extend in a parallel relationship along the width of the flexible panel 251. The ribs vertically strengthen flexible panel 251, while enabling the flexible panel 251 to flex in a direction along or parallel to the parallel ribs 263. Simultaneously therewith, the ribs inhibit the flexible panel 251 from flexing in a direction perpendicular to the parallel ribs 263.

Flexible panels 251 are fabricated of fiberglass, preferably in 4-foot by 8-foot panels, utilizing conventional fabrication techniques. First, a gel coat is applied to a flat 4×8 mold for forming the outer finished surface of the flexible panel 251. Next, a gun 200 having a dual nozzle 202 is used to simultaneously spray a resin hardener and fiberglass onto the surface of the mold, as well known in the art. The surface is thus built up to a thickness of approximately 0.6125 inches. Strips of cardboard or other disposable, biodegradable material are laid on the mold over the partially sprayed surface at spaced intervals, preferably every 1.0 feet. Spraying is then continued so that fiberglass ribs 263 form over the strips. The sheet is allowed to harden, and removed from the mold.

As best shown in FIGS. 29–32, a base 214 is contoured to form the bottom and partial sidewall of the pool 210 in an excavation. Base 214 comprises a peripheral edge 234 and an upper surface 244, and is constructed preferably of a cementitious material such as concrete. Polymeric and other material may also be used. A construction trench 236 is shown excavated about the peripheral edge 234 of the base 214. The trench 236 extends preferably 6–12 inches behind sidewall 250, and is therefore is substantially smaller than trench 36 of the original embodiment.

A plurality of upright supports 230 are mounted in the ground 27 adjacent to and at intervals about a peripheral edge 234 of the base 214. The intervals are selected such that upright supports 230 abut joints 253 on sidewall 250 when flexible panels 251 are installed. More frequent intervals may also be used. Upright supports 230 have lower ends 230A and upper ends 230B. Preferably, lower ends 230A of the upright supports 230 extend into the ground 27 a distance sufficient such that upper ends 230B are in a constant height relationship. The upright supports 230 are preferably fabricated from fiberglass, having a T-shaped cross sectional area and being pointed at lower end 230A to facilitate ground penetration.

A plurality of base coupling means 240 are disposed adjacent to the upright members 230 and extend over an upper surface 244 of the base 214. Preferably, the base coupling means 240 are constructed of a flexible fiberglass web or fiberglass cloth. The base coupling means 240 are secured to the upright members 230 upon the mounting of the sidewall 250 as described below.

Flexible panels 251 are disposed about the peripheral edge 234 of the base 214, abutting one another at joints 253, to form sidewall 250. As described previously, upright supports 230 are mounted in the ground 27 at joints 253 adjacent to peripheral edge 234 of the base 214. Flexible panels 251 are permanently secured to upright supports 230 by mechanical fasteners shown as screws 281 extending through the flexible panels 251 adjacent to joints 253 into the plurality of upright supports 230. Upright supports 230 thereby join adjacent flexible panels 251, and provide support for sidewall 250. The screws 281 at lower end 230A of upright supports 230 extend through the flexible panel 251, through the base coupling means 240, and into the upright supports 230 for securing the base coupling means 240. Sidewall 250 thus formed defines the inner surface 221 facing the interior volume 216 of the pool 210 and defines the outer surface 222 of the pool 210 facing the exterior of the pool 210.

When flexible panels 251 are thus mounted, parallel ribs 263 extend vertically enabling the sidewall 250 to flex in a horizontal direction parallel to the parallel ribs 263. Simultaneously therewith, the ribs 263 inhibit the sidewall 250 from flexing in a vertical direction perpendicular to the parallel ribs 263. This preferred flexing property of the sidewall 250 enables the sidewall 250 to be easily formed for the corners of the pool 210 as shown in FIG. 1. However, the preferred flexing property of the sidewall 250 inhibits the sidewall 250 from expanding outwardly under the hydraulic force produced by the water 18 within the pool 210. Concomitantly therewith, the preferred flexing property of the sidewall 250 inhibits the sidewall 250 from expanding inwardly under the hydraulic force of water within the ground 27 when the water 18 is removed from the pool 210.

As best shown in FIG. 32, contour panels 292 are permanently secured at each joint 253 on outer surface 222 of flexible panels 251 by mechanical fasteners shown as screws 276 extending through the sidewall 250 into the contour panels 292. Contour panels 292 may also be attached to outer surface 222 of sidewall 250 at other locations where added support is desired, such as at a bend or other potential weak spot.

Each contour panel 292 is molded in a contour shape. A cavity 294 is thus defined between flexible panel 251 and coutour panel 292. Concrete is poured into the mold formed by the cavity 294, forming pillar 296. Using trench 236 as a mold, a concrete footer 298 is poured to give added support to the pillar and to integrally mold the pillar 296 to the base 214 of the pool 210.

As shown in FIGS. 33–35, an important aspect of the present invention is the application of an inner coating 291 to provide a liquid tight seal as well as an aesthetic appearance to the inside surface 221 of the pool 210. FIG. 33 illustrates the application of the inner coating 291 to the inner surface 221 of the sidewall 250 as well as to the base 214 through the use of the spray gun 200. Preferably, the inner coating 291 is a polymeric resin and hardener simultaneously applied with chopped fiberglass strands ejected from a plurality of nozzles 202 of the coating gun 200. The coating gun 200 this type is commonly referred to as a "chopper gun" and is widely used in the industry.

FIGS. 34 and 35 illustrates the inner surface 221 of the sidewall 250 of the second embodiment with the inner coating 291 affixed thereto. The inner coating 291 is applied in a thickness sufficient to cover the screws 276 and screws 281. The inner coating 291 also bonds the base coupling means 240 to the upper surface 244 of base 214. The thickness of the inner coating 291 is of sufficient thickness to cover the base coupling means 240 and provides a smooth contour for the base 214. In addition, the inner coating 291 provides a water tight seal as well as an aesthetic appearance to the interior volume 216 of the pool 210.

FIG. 36 illustrates the final completion of the sidewall 250 of the second embodiment wherein the trench 236 has been filled with ground soil 27 and the slab 226 has been poured to engage with the sidewall 250, pillar 296 and concrete footer 298. The slab 226 is prepared in a conventional manner with an overhang 208 being constructed through the use of a form (not shown). Pillars 296 provide added support for slab 226, thus preventing cracking of the slab 226 if the soil beneath is eroded.

The invention is also incorporated into the method of making a pool comprising excavating a hole in the ground in the shape and the depth of the desired pool. A plurality of upright supports are installed into the ground about the periphery of the excavated hole. A plurality of flexible panels are affixed to the plurality of upright supports for defining the sidewall of the pool, with two flexible panels being affixed to each upright support. A plurality of contour panels are affixed to the outer surface of the sidewall to form a plurality of cavities therebetween, each contour panel being affixed to two flexible panels. A cementitious base is poured within the sidewall to form the bottom of the pool. A cementitious footer is poured without the sidewall for integrally molding the cementitious support columns to the cementitious base. A plurality of cementitious vertical support columns are poured within the cavities for supporting the sidewall and integrally joining the flexible panels. A fiberglass coating is applied on the inner surface of the sidewall and on the cementitious base for affixing the sidewall to the cementitious base and for forming an interior surface for the pool.

The second embodiment of the present invention enables the construction of either an in ground or an above ground pool of unlimited size and superior mechanical strength, and enjoying all the other advantages of the original embodiment as described above. In addition to those advantages, the use of flexible panels 251 made of fiberglass ensures sufficient adhesion of the sprayed fiberglass inner surface 221 and sufficient strength of the sidewall 250 so as to allow for the elimination of the holes 87 and horizontal supports 70 required in the original embodiment to ensure sufficient sidewall strength and inner surface adhesion. As such, no rear spraying is required. The excavation required is thus minimized, thereby reducing labor and material costs, while improving quality. Also, integrally formed ribs 263 in flexible panels 251 further improve the support characteristics of sidewall 250.

The new embodiment discloses upright supports 230 specifically designed for this purpose. Being T-shaped and pointed, upright supports 230 have smaller cross sectional area than wood stakes, thus offering easier ground penetration, and are thus easier to install and work with. Because upright supports 230 are fabricated of fiberglass, they offer superior supporting qualities, and last longer than wood. Moreover, each upright support 230 is reinforced by concrete pillars 296 poured into cavities 294 formed by contour panels 292 attached to the outer surface 222 of sidewall 250. This added support ensures so that decking or other weighty material placed about the periphery of the pool 210 is easily supported, and will not crack if the supporting soil beneath is eroded. These improvements result in lower labor and material costs, and a higher quality product.

Finally, this embodiment offers a pool 210 made entirely of concrete and fiberglass. No polyethylene, wood, or other materials are needed in the construction. The pool 210 thus enjoys the structural and endurance properties of fiberglass and concrete.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A swimming pool apparatus, comprising:

a base extending within a peripheral edge with said base supported by ground soil;

said base being contoured to form the bottom of the pool;

a sidewall extending about said peripheral edge of said base;

said sidewall having an inner surface facing an interior of the pool and an outer surface facing an exterior of the pool;

an inner coating disposed on said inner surface of said sidewall and disposed on said base for affixing said sidewall to said base and for forming an interior surface for the pool;

said sidewall comprising a plurality of flexible panels;

said plurality of flexible panels defining a plurality of vertical joints;

a plurality of upright supports affixed to said outer surface of said sidewall at said vertical joints with said plurality of upright supports extending into said ground soil;

a plurality of contour panels affixed to said outer surface of said sidewall proximate said vertical joints for defining a plurality of cavities therebetween;

said cavities containing said upright supports; and a plurality of vertical support columns molded within said cavities for supporting said sidewall and integrally joining said flexible panels.

2. A swimming pool apparatus as set forth in claim 1, wherein said base comprises a cementitious material.

3. A swimming pool apparatus as set forth in claim 1, wherein said inner coating comprises a coating of fiberglass.

4. A swimming pool apparatus as set forth in claim 1, wherein said plurality of flexible panels are fiberglass.

5. A swimming pool apparatus as set forth in claim 1, wherein each of said flexible panels comprises a plurality of vertical ribs; and said plurality of vertical ribs enabling each of said plurality of flexible panels to flex in a horizontal direction and for inhibiting each of said plurality of flexible panels from flexing in a vertical direction.

6. A swimming pool apparatus as set forth in claim 1, wherein each of said contour panels is affixed to each of two flexible panels.

7. A swimming pool apparatus as set forth in claim 1, wherein said vertical support columns comprise a cementitious material.

8. A swimming pool apparatus as set forth in claim 1, wherein said vertical support columns are integrally molded with said base.

9. A swimming pool apparatus, comprising:

a base extending within a peripheral edge;

said base being contoured to form the bottom of the pool;

a sidewall extending about said peripheral edge of said base;

said sidewall having an inner surface facing an interior of the pool and an outer surface facing an exterior of the pool.

an inner coating disposed on said inner surface of said sidewall and disposed on said base for affixing said sidewall to said base and for forming an interior surface for the pool;

said sidewall comprising a plurality of flexible panels;

said plurality of flexible panels defining a plurality of vertical joints;

a plurality of upright supports affixed to said outer surface of said sidewall at said vertical joints;

a plurality of contour panels affixed to said outer surface of said sidewall proximate said vertical joints for defining a plurality of cavities therebetween;

said cavities containing said upright supports;

a plurality of vertical support columns molded within said cavities for supporting said sidewall and integrally joining said flexible panels; and fastening means extending through said sidewall and said upright supports for affixing said upright supports to said outer surface of sidewall.

10. A swimming pool apparatus, comprising:

a base extending within a peripheral edge;

said base being contoured to form the bottom of the pool;

a sidewall extending about said peripheral edge of said base;

said sidewall having an inner surface facing an interior of the pool and an outer surface facing an exterior of the pool;

an inner coating disposed on said inner surface of said sidewall and disposed on said base for affixing said sidewall to said base and for forming an interior surface for the pool;

said sidewall comprising a plurality of flexible panels;

said plurality of flexible panels defining a plurality of vertical joints;

a plurality of upright supports affixed to said outer surface of said sidewall at said vertical joints;

a plurality of contour panels affixed to said outer surface of said sidewall proximate said vertical joints for defining a plurality of cavities therebetween;

said cavities containing said upright supports;

a plurality of vertical support columns molded within said cavities for supporting said, sidewall and integrally joining said flexible panels; and mounting means extending through said sidewall and said contour panels for affixing said contour panels to said sidewall.

11. A swimming pool apparatus, comprising:

a cementitious base extending within a peripheral edge with said cementitious base being supported by ground soil;

said cementitious base being contoured to form the bottom of the pool;

a sidewall extending about said peripheral edge of said cementitious base;

said sidewall having an inner surface facing an interior of the pool and an outer surface facing an exterior of the pool;

an inner coating of fiberglass disposed on said inner surface of said sidewall and disposed on said cementitious base for affixing said sidewall to said cementitious base and for forming an interior surface for the pool;

said sidewall comprising a plurality of flexible panels;

said plurality of flexible panels being fiberglass;

said plurality of flexible panels defining a plurality of vertical joints;

a plurality of upright supports affixed to said outer surface of said sidewall at said vertical joints with said plurality of upright supports extending into said ground soil;

a plurality of contour panels affixed to said outer surface of said sidewall proximate said vertical joints for defining a plurality of cavities therebetween;

said cavities containing said upright supports; and a plurality of vertical support columns molded within said cavities for supporting said sidewall and integrally joining said flexible panels.

12. A swimming pool apparatus as set forth in claim 11, wherein each of said flexible panels comprises a plurality of vertical ribs; and said plurality of vertical ribs enabling each of said plurality of flexible panels to flex in a horizontal direction and for inhibiting each of said plurality of flexible panels from flexing in a vertical direction.

13. A swimming pool apparatus as set forth in claim 11, wherein said vertical support columns comprises a cementitious material.

14. A swimming pool apparatus as set forth in claim 11, wherein said vertical support columns are integrally molded with said base.

15. The method of making an in ground swimming pool, comprising the steps of:

excavating a hole in the ground in the shape and the depth of the desired pool;

installing plurality of upright supports into the ground about the periphery of the excavated hole;

affixing two of a plurality of flexible panels to each of the plurality of upright supports for defining the sidewall of the pool;

affixing a plurality of contour panels to the sidewall of the pool for defining a plurality of cavities therebetween;

pouring a cementitious base within the sidewall to form the bottom of the pool;

applying a fiberglass coating on an inner surface of the sidewall and on the cementitious base for affixing the sidewall to the cementitious base and for forming an interior surface for the pool; and pouring a plurality of cementitious vertical support columns within the cavities for supporting the sidewall and integrally joining the flexible panels.

16. The method of making an in ground swimming pool as set forth in claim 15, including the step of pouring a cementitious footer without the sidewall for integrally molding the cementitious support columns to the cementitious base.

17. The method of making an in ground swimming pool as set forth in claim 15, wherein the step of affixing the contour panels to the sidewall of the pool includes affixing each contour panel to two flexible panels.

* * * * *